US008932788B2

(12) United States Patent
Wakamatsu et al.

(10) Patent No.: US 8,932,788 B2
(45) Date of Patent: Jan. 13, 2015

(54) TONER, DEVELOPER, AND IMAGE FORMING METHOD

(75) Inventors: Shinichi Wakamatsu, Numazu (JP); Hiroshi Yamashita, Numazu (JP); Naohiro Watanabe, Shizuoka (JP); Tsuyoshi Sugimoto, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 993 days.

(21) Appl. No.: 12/245,973

(22) Filed: Oct. 6, 2008

(65) Prior Publication Data

US 2009/0104555 A1 Apr. 23, 2009

(30) Foreign Application Priority Data

Oct. 18, 2007 (JP) ..... 2007-271705

(51) Int. Cl.

*G03G 9/09* (2006.01)
*G03G 9/08* (2006.01)
*G03G 9/087* (2006.01)

(52) U.S. Cl.

CPC ..... *G03G 9/0819* (2013.01); *G03G 9/0804* (2013.01); *G03G 9/0806* (2013.01); *G03G 9/0821* (2013.01); *G03G 9/0823* (2013.01); *G03G 9/08726* (2013.01); *G03G 9/08755* (2013.01); *G03G 9/08764* (2013.01); *G03G 9/08793* (2013.01)

USPC ..... 430/108.22; 430/108.4; 430/109.4; 430/110.4; 430/111.4; 430/123.57; 430/123.5

(58) Field of Classification Search

USPC ..... 430/111.4, 110.4, 109.4, 108.4, 108.22, 430/123.57, 123.5, 124.1

See application file for complete search history.

(56) References Cited

U.S. PATENT DOCUMENTS

| | | | | |
|---|---|---|---|---|
| 5,840,456 | A * | 11/1998 | Tomita et al. | 430/109.1 |
| 6,285,841 | B1 * | 9/2001 | Miho | 399/55 |
| 2004/0053155 | A1 * | 3/2004 | Emoto et al. | 430/137.15 |
| 2005/0164112 | A1 | 7/2005 | Ohki et al. | |
| 2006/0046174 | A1 * | 3/2006 | Ohki et al. | 430/111.4 |
| 2008/0160434 | A1 * | 7/2008 | Sensui et al. | 430/48 |
| 2011/0097661 | A1 * | 4/2011 | Ishigami et al. | 430/108.7 |

FOREIGN PATENT DOCUMENTS

| | | | |
|---|---|---|---|
| JP | 62-129865 | | 6/1987 |
| JP | 5-40908 | | 6/1993 |
| JP | 11-167226 | | 6/1999 |
| JP | 2000-98777 | A | 4/2000 |
| JP | 3127601 | | 11/2000 |
| JP | 2001-89682 | | 4/2001 |
| JP | 2001-324835 | | 11/2001 |
| JP | 2002-311645 | | 10/2002 |
| JP | 2004-20908 | | 1/2004 |
| JP | 2004-77766 | A | 3/2004 |
| JP | 2005-181835 | A | 7/2005 |
| JP | 2005-181839 | | 7/2005 |
| JP | 2005-352128 | | 12/2005 |
| JP | 2006-38961 | A | 2/2006 |
| JP | 3778193 | | 3/2006 |
| JP | 2006-145703 | | 6/2006 |
| JP | 2006-293304 | A | 10/2006 |
| JP | 3983134 | | 7/2007 |
| JP | 2007-248550 | A | 9/2007 |
| WO | WO 85/00440 | | 1/1985 |
| WO | WO 2006064796 | A1 * | 6/2006 |

OTHER PUBLICATIONS

U.S. Appl. No. 12/143,244, filed Jun. 20, 2008, Watanabe, et al.

* cited by examiner

*Primary Examiner* — Christopher Rodee

(74) *Attorney, Agent, or Firm* — Oblon, Spivak, McClelland, Maier & Neustadt, L.L.P.

(57) ABSTRACT

The present invention provides a toner containing at least a binder resin and a pigment, wherein the amount of the pigment in the toner is 3.0% by mass to 8.5% by mass, the volume average particle diameter of the toner is 2.0 μm to 6.0 μm, and a monochrome image, which has been fixed on a recording medium so that the amount of the toner adhered onto the recording medium is 0.25 mg/cm$^2$, has a reflection density of 1.2 to 2.5.

15 Claims, 5 Drawing Sheets

TONER, DEVELOPER, AND IMAGE FORMING METHOD

BACKGROUND OF THE INVENTION

1. Field of the Invention

The present invention relates to a toner which is used for developing a latent electrostatic image in electrophotographic copiers, laser printers, facsimiles and so forth and is suitable for forming a color image, and also relates to a developer and an image forming method each using the toner.

2. Description of the Related Art

In electrographic color image forming apparatuses, in order to yield an image density (ID; reflection density of a toner image on a sheet of paper) of 1.2 with each of monochrome color images of cyan (C), magenta (M), and yellow (Y), conventionally a toner adhesion amount (adhesion amount of a toner on a unit area of a recording medium) of 0.4 mg/cm$^2$ (4.0 g/m$^2$) or more has been required.

In recent years, it has been requested to solve environmental problems in many fields of industry, however, it has been difficult to reduce toner adhesion amounts in the electrographic industry, leaving such environmental problems unsolved.

Furthermore in development of toner, there are some cases in which a pigment is used at a high concentration (11% by mass to 20% by mass) to the total amount of toner. In such cases, the image density (ID) can be increased. However the simple body of pigment is expensive, the toner price is raised because of high concentration of pigment used in the toner. In addition, the use of pigment at high concentration decreases image sharpness.

On the other hand, commercially available conventional toners have a volume average particle diameter of 5.1 μm at the minimum, and therefore, have been insufficient for satisfying today's demands for obtaining high resolution images and highly fine images. The quality of images produced by using any of commercially available conventional toners is still insufficient as compared to the quality of images produced by offset lithography. Images produced using any of commercially available conventional toners are also inferior in color reproduction ranges to images produced by offset lithography.

For example, Japanese Patent Application Laid-Open (JP-A) No. 2006-145703 describes that an optical reflection density (ID) of 1.3 is yielded with an adhesion amount of yellow toner of 0.1 mg/cm$^2$ to 0.5 mg/cm$^2$, using C. I. Pigment Yellow (PY) 185. However, in the Examples of JP-A No. 2006-145703, it is described that the toner adhesion amount with which an image density (ID) of 1.3 measured by X-RITE reflection densitometer (manufactured by X-Rite Co.) is yielded is 0.32 mg/cm$^2$ at the minimum. Based upon the results of the Examples, the adhesion amount of yellow toner at which an image density (ID) reaches 1.2 becomes 0.30 mg/cm$^2$, when converted into a relationship between image density data that has been accumulated in the past and adhesion amounts of toner. The adhesion amount of toner still remains large.

In JP-A No. 2005-352128, optical density is measured based upon light transmittance instead of light reflectance. It is known to those skilled in the art that the difference between the reflection density and transmission density is not so significant that it would affect comparative results in optical density. In the Examples of the above application, ID of 1.07 for cyan, 1.06 for magenta, and 1.06 for yellow at the maximum were yielded, with a toner adhesion amount of 0.4 mg/cm$^2$ [=4.0 g/m$^2$]. The adhesion amount of toner still remains large.

Also in Japanese Patent (JP-B) No. 3778193, the optical density has been measured using light transmittance instead of light reflectance, however as mentioned above the difference between the optical density measured using light transmittance and the optical density measured using light reflectance is not significant. In the Examples of the above specification, ID of 1.38 for cyan, 1.29 for magenta, and 1.24 for yellow at the maximum were yielded with a toner adhesion amount of 0.35 mg/cm$^2$. These correspond to toner adhesion amounts of 0.30 mg/cm$^2$ for cyan, 0.32 mg/cm$^2$ for magenta, and 0.34 mg/cm$^2$ for yellow, for an image density (ID) of 1.2 to be yielded, which are calculated in the same manner as described above by calculation. The toner adhesion amounts of the Examples of the above specification are still large. In addition, in 3C, 3M, and 3Y in the Examples of the above specification, the amount of each pigment added was 11% by mass, which is high and thus has the same problem as described above.

Furthermore, JP-A No. 2001-324835 discloses a yellow toner which exhibits a reflectance of 15% or less to light having a wavelength of 440 nm to 460 nm and a reflectance of 50% or more to light having a wavelength of 500 nm, and discloses spectral reflectivities of toners in the Examples. When a reflection density (ID) to the spectral range of 400 nm to 700 nm is calculated based on the spectral reflectivities, the ID is 0.32. The reflection density (ID) is 0.37 in an example cited as known example. The toner adhesion amount is 0.4 mg/cm$^2$, and thus remains large. In Examples 1 to 6 and 8, the toner adhesion amount still remains large. In Example 7 the amount of pigment added is large constituting a problem similar to that described above.

In JP-A No. 11-167226, the reflection density is measured using a status-A filter, which is an International Standard for color density measurement and different from a status-I filter used in density measurement of color images in common electrography. The reflection density measured by using the status-A filter is slightly different from the reflection density measured by using the status-I filter, however the difference causes no problem when the resulting reflection densities are compared. In Example 2, with a toner adhesion amount of 0.1 mg/cm$^2$ [=1 g/m$^2$], densities, which were measured by using a status-A filter, of 1.26 for cyan, 1.22 for magenta, and 1.25 for yellow were yielded. The amount of pigment added was 15% by mass, which is a problem similar to that mentioned above.

Thus, at present, it has been desired to promptly provide a toner which achieves a sufficient image density with a normal addition amount of pigment, without the necessity of adding a large amount of pigment, even with a low toner adhesion amount, and decreases a toner consumption rate to thereby contribute to solution to environmental problems, and achieves a high quality image, and can enlarge the color reproduction range, and provide related technologies.

BRIEF SUMMARY OF THE INVENTION

An object of the present invention is to provide a toner which can achieve a sufficient image density with a normal addition amount of pigment, without the necessity of adding a large amount of pigment, even with a low toner adhesion amount, decrease a toner consumption rate, thereby contributing to a solution to environmental problems, produce a high quality image, and enlarge the color reproduction range, and also to provide a developer and an image forming method each using the toner.

Means for solving the above problems are as follows:

<1> A toner containing at least a binder resin and a pigment, wherein the amount of the pigment in the toner is 3.0% by mass to 8.5% by mass, the volume average particle diameter of the toner is 2.0 sum to 6.0 μm, and a monochrome image, which has been fixed on a recording medium so that the amount of the toner adhered onto the recording medium is 0.25 mg/cm$^2$, has a reflection density of 1.2 to 2.5.

<2> The toner according to the item <1>, wherein a coat layer prepared by applying onto a base a solution in which 10 g of the toner is dissolved in 40 g of tetrahydrofuran, using a wire bar having a wire diameter of 0.3 mm, has a haze degree of 0.1 to 25.

<3> The toner according to any one of the items <1> and <2>, further containing at least a pigment dispersant.

<4> The toner according to the item <3>, wherein the pigment dispersant is a polyester pigment dispersant.

<5> The toner according to the item <3>, wherein the pigment dispersant is a polyurethane pigment dispersant.

<6> The toner according to the item <3>, wherein the pigment dispersant is an acrylic pigment dispersant.

<7> The toner according to any one of the items <1> to <6>, further containing at least a synergist.

<8> The toner according to any one of the items <1> to <7>, wherein the toner is at least one selected from a yellow toner, a magenta toner, and a cyan toner.

<9> The toner according to any one of the items <1> to <8>, wherein the toner has a ratio (Dv/Dn) of a volume average particle diameter (Dv) to a number average particle diameter (Dn) of 1.00 to 1.20.

<10> The toner according to any one of the items <1> to <9>, wherein the toner is obtained by dissolving or dispersing in an organic solvent at least a binder resin and a pigment to prepare a solution or dispersion, suspending or emulsifying the solution or dispersion in an aqueous medium so as to obtain a granulated dispersion liquid, and removing the solvent from the dispersion liquid.

<11> The toner according to any one of the items <1> to <9>, wherein the toner is obtained by dissolving or dispersing in an organic solvent at least a compound having an active hydrogen group and a polymer having a site capable of reacting with the compound having an active hydrogen group to obtain a solution or a dispersion, subjecting the solution or dispersion to a cross-linking or elongation reaction in an aqueous medium to obtain a dispersion liquid, and removing the solvent from the dispersion liquid.

<12> The toner according to the item <11>, wherein the polymer having a site capable of reacting with the compound having an active hydrogen group is a modified polyester resin (i) having a substituent capable of undergoing a cross-linking or an elongation reaction.

<13> The toner according to the item <12>, wherein the substituent capable of undergoing a cross-linking or an elongation reaction in the modified polyester resin (i) is an isocyanate group.

<14> The toner according to any one of the items <10> to <13>, wherein the binder resin contains an unmodified polyester resin (ii) together with the modified polyester resin (i) formed by a cross-linking or an elongation reaction, and a mass ratio [(i)/(ii)] is 5/95 to 30/70.

<15> A developer composed of at least the toner according to any one of the items <1> to <14> and a carrier.

<16> An image forming method including at least forming a latent electrostatic image on a latent electrostatic image bearing member, developing the latent electrostatic image using a toner to form a visible image, transferring the visible image onto a recording medium, and fixing the transferred image on the recording medium, wherein the toner is a toner according to any one of the items <1> to <14>.

<17> An image forming apparatus including at least a latent electrostatic image bearing member, a latent electrostatic image forming unit configured to form a latent electrostatic image on the latent electrostatic image bearing member, a developing unit configured to develop the latent electrostatic image using a toner to form a visible image, a transfer unit configured to transfer the visible image onto a recording medium, and a fixing unit configured to fix the transferred image transferred onto the recording medium, wherein the toner is a toner according to any one of the items <1> to <14>.

<18> A process cartridge including at least a latent electrostatic image bearing member, and a developing unit configured to develop a latent electrostatic image formed on the latent electrostatic image bearing member using a toner to form a visible image, wherein the process cartridge is removable from the main body of an image forming apparatus, and the toner is a toner according to any one of the items <1> to <14>.

A toner according to the present invention contains at least a binder resin and a pigment, wherein the amount of the pigment in the toner is 3.0% by mass to 8.5% by mass, the volume average particle diameter of the toner is 2.0 μm to 6.0 μm, and a monochrome image, which has been fixed on a recording medium so that the amount of the toner adhered onto the recording medium is 0.25 mg/cm$^2$, has a reflection density of 1.2 to 2.5.

The toner according to the present invention can produce a reflection density (ID) of 1.2 to 2.5, which is about the same level as conventional toners, even with a toner adhesion amount as small as 0.25 mg/cm$^2$ and even with a concentration of pigment as low as 3.0% by mass to 8.5% by mass, can reduce the consumption amount of a toner substantially by half, can contribute to a solution to environmental problems, and can thereby prevent a cost rise of a toner. Furthermore the toner according to the present invention can prevent a decrease in sharpness (resolution as well), produce high resolution and highly fine images, further enlarge the color reproduction range, and achieve a quality close to the quality of images formed by offset printing.

The present invention can solve the problems of the related art, can provide a toner which produces a sufficient image density with a normal addition amount of pigment, without the necessity of adding a large amount of pigment, even with a low toner adhesion amount, decreases a toner consumption rate, thereby contributing to a solution to environmental problems, and which produces a high quality image, and enlarges the color reproduction range, and can also provide a developer and an image forming method each using the toner.

DETAILED DESCRIPTION OF THE INVENTION (Toner)

Figure 1:
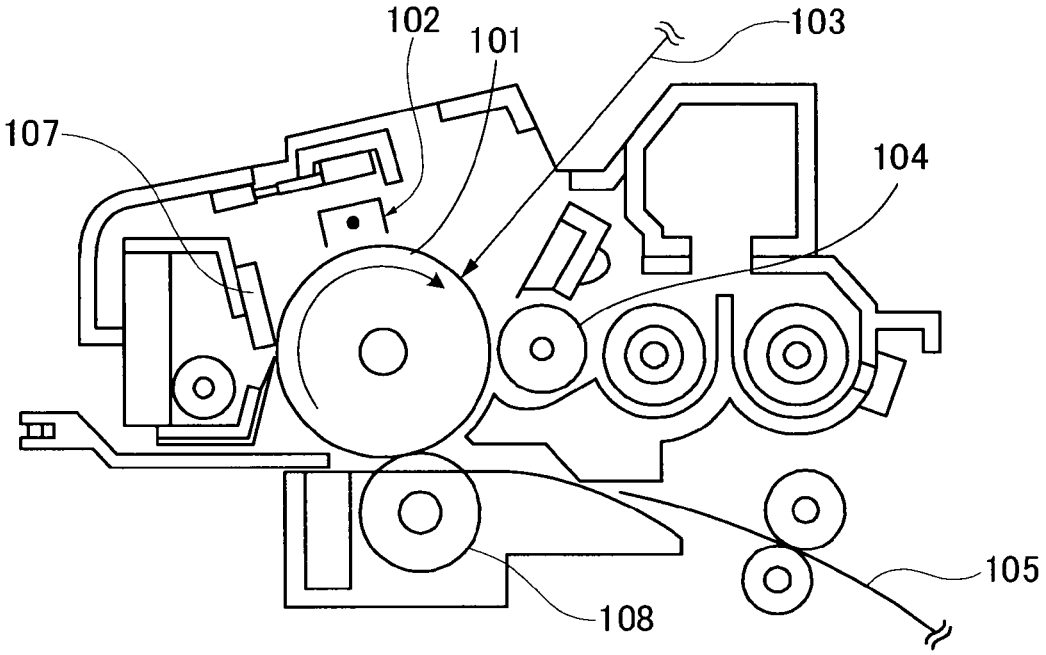
FIG. 1 is a schematic illustration showing an example of a process cartridge according to the present invention.

A toner according to the present invention contains at least a binder resin and a pigment, contains a pigment dispersant, a releasing agent, a charge control agent, and further contains additional components as required.

In the present invention, a pigment as a colorant is preferably uniformly dispersed or dissolved inside toner particles. Although as a colorant a dye can also be used, a pigment is actually used because of its excellence in light resistance, etc.

Any conventional technology can be used for dispersing the pigment. For example, a pigment may be mixed with a binder resin, kneaded using a two-roll mill, then cold-rolled, and pulverized by a pulverizer to prepare a dispersion of master batch, or may be dispersed in a liquid using a medium such as zirconia beads by means of such a device as ball mill, paint shaker, rocking mill, sand mill, and bead mill.

When a pigment is used as a colorant, the pigment is preferably uniformly dispersed and stabilized in a toner by a pigment dispersant. In this case, the dispersion particle diameter of the pigment can be measured by such a method as laser scattering diffraction method, laser Doppler method, centrifugal sedimentation method, and ultrasonic attenuation measurement method.

The laser scattering diffraction method requires high dilution, which makes it difficult to set parameters. The laser Doppler method requires dilution, though the measurement can be performed with relatively low dilution. It takes long time to measure the dispersion particle diameter by the centrifugal sedimentation method. The ultrasonic attenuation measurement method requires many parameters for measurement, and requires parameter setting for each material.

Thus conventional methods for measuring a dispersion particle diameter involve troublesome procedures for measurement, requiring high dilution, and taking long time, and all of the conventional methods for measuring a dispersion particle diameter have difficulty in measuring an accurate dispersion particle diameter.

In contrast, in the present invention, as a measure of the transparency (there is a correlation between the transparency and the dispersion particle diameter) the haze degree is adopted. The degree of dispersion of a pigment in a toner is quantified as a haze degree in the present invention.

The haze degree is preferably 0.1 to 25, and more preferably 0.1 to 20. When the haze degree is less than 0.1, the toner becomes to have less hiding power to degrade tinting strength. When the haze degree is more than 25, the degree of dispersion of a pigment becomes insufficient, and this may sometimes cause degradation of tinting strength and color saturation.

The haze degree can be measured by applying onto a base a solution, in which 10 g of the toner with a pigment is dissolved in 40 g of tetrahydrofuran, using a wire bar having a wire diameter of 0.3 mm, to prepare a coat layer containing the toner, and measuring the haze degree of the coat layer by, for example, TM double beam type automatic haze computer (manufactured by SUGA TEST INSTRUMENTS CO., LTD.)

The substrate is preferably a transparent film; examples thereof include a PET film, a PP film, and a PE film.

According to the present invention, the reflection density (ID) of a monochrome image fixed on a recording medium with an adhesion amount of toner of 0.25 mg/cm$^2$ is 1.2 to 2.5, and preferably 1.3 to 2.0. Since the required amount of toner for printing can be reduced, the following are achieved: an environmental load is reduced because of a reduction of the amount of raw material; the cost of toner is reduced because of a reduction of the used amount of a pigment which is a high cost material; and a solid image with uniform image density is produced by reduction of image thickness, thereby unevenness of toner adhesion can be reduced in a solid image or in edges thereof. Furthermore solid images with uniform image density can also be obtained by uniformly dispersing a pigment.

When the reflection density is less than 1.2, sometimes an original image cannot be reproduced due to insufficient tinting strength. When the reflection density is more than 2.5, sometimes color reproductivity is degraded, as well as the cost of a toner is raised because of a large amount of pigment used.

The recording medium is not particularly limited, and can be appropriately selected depending on the purpose; examples thereof include OHP sheets, in addition to paper media such as art paper, coat paper, and plain paper.

The fixing method is not particularly limited, and can be appropriately selected depending on the purpose; a preferable example include oilless fixing method.

<Pigment>

The pigment is not particularly limited and can be appropriately selected from known pigments depending on the purpose. Examples thereof include carbon black, nigrosine dye, iron black, naphthol yellow S, hanza yellow (10 G, 5 G, and G), cadmium yellow, yellow iron oxide, ocher (Chinese yellow), chrome yellow, titan yellow, polyazo yellow, oil yellow, hanza yellow (GR, A, RN, R), pigment yellow L, benzidine yellow (G, GR), permanent yellow (NCG), vulcan fast yellow (5G and R), tartrazine lake, quinoline yellow lake, anthrazan yellow BGL, isoindolinone yellow, bengala (Indian red), red lead (primer), vermilion red, cadmium red, cadmium mercury red, antimony red, permanent red 4R, para red, fire red, p-chloro o-nitro aniline red, lithol fast scarlet G, brilliant fast scarlet, brilliant carmine BS, permanent red (F2R, F4R, FRL, FRLL, and F4RH), fast scarlet VD, vulcan fast rubin B, brilliant scarlet G, lithol rubin GX, permanent red F5R, brilliant carmine 6B, pigment scarlet 3B, bordeaux 5B, toluedine maroon, permanent bordeaux F2K, hello bordeaux BL, bordeaux 10B, bon maroon light, bon maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulian blue, alkali blue lake, peacock blue lake, victoria blue lake, metal-free phthalocyanine blue, phthalocyanine blue, fast sky blue, indanthrene blue (RS and BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, Chinese white (zinc oxide), lithopone, and the like. These may be used alone or in combination. Note that a combination of the pigment and a known dye may be used.

The amount of the pigment in the toner is 3.0% by mass to 8.5% by mass, and preferably 4.0% by mass to 8% by mass. Thus the cost of the entire toner can be reduced by reducing the amount of the pigment, which is a relatively expensive material. When the amount of the pigment in the toner is less than 3.0% by mass, it becomes sometimes difficult to reproduce an original image because the tinting strength becomes insufficient. When the amount of the pigment in the toner is more than 8.5% by mass, it may sometimes cause degradation of color reproductivity due to its excessive amount of pigment, as well as degradation of electrostatic chargeability, flowability, and fixing property which are necessary additional properties requested to the toner.

<Pigment Dispersant>

Examples of the pigment dispersant include polyester pigment dispersants, acrylic pigment dispersants, and polyurethane pigment dispersants.

Examples of the polyester pigment dispersant include AJISPER PB821, AJISPER PB822, AJISPER PB711 (manufactured by Ajinomoto Fine-Techno Co., Inc.); and DISPARLON DA-705, DISPARLON DA-325, DISPARLON DA-725, DISPARLON DA-703-50, DISPARLON DA-234 (manufactured by Kusumoto Chemicals Ltd.).

Examples of the acrylic pigment dispersant include Disperbyk 2000, Disperbyk 2001, Disperbyk 2020, Disperbyk 2050, Disperbyk 2150 (manufactured by BYK Japan KK).

Examples of the polyurethane pigment dispersant include EFKA 4010, EFKA 4009, EFKA 4015, EFKA 4047, EFKA 4050, EFKA 4055, EFKA 4060, EFKA 4080, EFKA 4520 (manufactured by Chiba Specialty Chemicals, Inc.).

The amount of the pigment dispersant is preferably 1 part by mass to 100 parts by mass per 100 parts by mass of the pigment, and more preferably 5 parts by mass to 50 parts by mass. When the amount is less than 1 part by mass, the effect of the pigment dispersant is small and the pigment dispersant sometimes fails in sufficiently dispersing a pigment and stabilizing the pigment. When the amount is more than 100 parts by mass, it causes degradation of quality, for example, it causes a plasticization of a binder resin used and degradation in chargeability, and sometimes disadvantageously affects on the cost of the toner.

—Synergist—

In the present invention, a synergist is preferably used to appropriately disperse a pigment. The synergist is a derivative having a similar chemical structure to a pigment, and means a compound which exhibits a strong interaction with a pigment as well as a polymer dispersant.

It is considered that the use of the synergist in combination with a polymer dispersant can effectively disperse even a pigment having a small amount of an acid or a base through an interaction between the pigment and the polymer dispersant. For example, when to a dispersion of quinacrydone pigment, dimethylaminoethyl quinacrydone, which is a derivative of the quinacrydone pigment, is added as a synergist, surfaces of pigment particles strongly adsorb dimethylaminoethyl quinacrydone because of the synergist's having a common chemical skeleton to the quinacridone pigment. Such an interaction between the synergist and the pigment is considered to be caused by a Van der Waals' force. The strong adsorption suitable for is practical use is considered to be brought about by the flat and large area of the colorant skeleton for the interaction between the synergist and the pigment. In addition dimethylaminoethyl quinacrydone contains a tertiary amino group, which is a basic functional group. When the polymer dispersant contains an acid functional group, the polymer indirectly adsorbs the pigment through an adsorption of the synergist, thereby the pigment can be stably dispersed.

As synergists for a yellow toner and a cyan toner, commercialized products may be used. Examples of the commercialized product having an acid functional group include SOLSPERSE22000 and SOLSPERSE5000 (manufactured by Lubrizol Japan Ltd.).

The amount of the synergist in the toner is preferably 0.1% by mass to 1% by mass.

—Binder Resin—

The binder resin is not particularly limited, and any binder resin can be used so long as it is known. Examples thereof include polymers or copolymers of monomers such as, styrenes (styrene, p-chlorostyrene, and α-methylstyrene, etc.), esters having an unsaturated bond (methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, and 2-ethylhexyl methacrylate, etc.), nitrites having an unsaturated bond (acrylonitrile and methacrylonitrile, etc.), vinyl ethers (vinyl methyl ether and vinyl isobutyl ether, etc.), vinyl ketones (vinyl methyl ketone, vinyl ethyl ketone, and vinyl isopropenyl ketone, etc.), and olefins (ethylene, propylene, and butadiene, etc.), or mixtures of these polymers or copolymers.

Examples of the binder resin further include non-vinyl condensation resins such as epoxy resins, polyester resins, polyurethane resins, polyamide resins, cellulose, and polyether resins; mixtures of these non-vinyl condensation resins with the vinyl resins; or graft polymers obtained by polymerizing a vinyl monomer in the presence of these polymers. Among these, polyester resins are particularly preferred in terms of their excellent low temperature fixing property and color reproductivity, etc.

For the polyester resin, a modified polyester resin (i) and an unmodified polyester resin (ii) may be used. These may be used alone, however, it is preferred to use the modified polyester resin (i) and the unmodified polyester resin (ii) in combination in terms of improvement of low temperature fixing property and glossiness when used in a full-color apparatus.

The modified polyester resin (i) and the unmodified polyester resin (ii) are described in detail below.

In the present invention, the modified polyester resin means a polyester resin, in which there exist a functional group in an acid monomer unit or an alcohol monomer unit and a bonding group that does not participate in the ester bond, or a polyester resin to which other resin having a different composition from that of the polyester resin is covalently or ionically bonded. For example, the modified polyester resin includes a polyester resin in which polyester terminals form bonds, type of which is other than ester bond, with other resin component. Specifically the modified polyester resin includes a polyester resin in which a functional group such as an isocyanate group, which reacts with an acid group or a hydroxyl group, is introduced to the terminals, and in which the isocyanate groups at the terminals are further reacted with active hydrogen compounds and the terminals are modified or elongated thereby. When the modified polyester resin contains a plurality of active hydrogen group, a modified polyester resin in which the polyester terminals are bonded to each other (urea modified polyester and urethane modified polyester, etc.) is also included in the modified polyester resin. The modified polyester resin further includes a polyester resin in which reactive groups, such as double bond, are introduced in a main chain of the polyester resin, in which graft components of C—C bonds are introduced as side chains by generating a radical polymerization reaction at the sites of the double bond, and in which alternatively a cross-link between double bonds is formed (styrene modified polyester and acryl modified polyester, etc.).

Furthermore, the modified polyester resin includes a polyester resin, in which other resin having a composition different from that of the polyester resin is copolymerized in a main chain of the polyester resin or reacted with carboxyl groups or hydroxyl groups at the terminals of the polyester resin. For example, it includes a polyester resin copolymerized with a silicone resin in which the terminals are modified with a carboxyl group, a hydroxyl group, an epoxy group, or a mercapto group (silicone modified polyester, etc.).

A modified polyester resin (i) with urea bonds includes a reaction product of a modified polyester resin having isocyanate groups (A) with an amine (B). The modified polyester resin having isocyanate groups (A) includes a reaction product of polyisocyanate (3) and a polycondensation reaction product of a polyol (1) and a polycarboxylic acid (2), wherein the polycondensation reaction product contain an active hydrogen group. The active hydrogen groups in the polyester include, for example, a hydroxyl group (alcoholic hydroxyl group and phenolic hydroxyl group), an amino group, a carboxyl group, and a mercapto group. Among these, alcoholic hydroxyl groups are particularly preferred.

The polyol (1) includes, for example, a diol (1-1) and a trivalent or more polyol (1-2). As the polyols, a diol (1-1) alone or a mixture of a diol (1-1) with a small amount of a trivalent or more polyol (1-2) is preferably used.

Examples of the diol (1-1) include alkylene glycols (such as ethylene glycol, 1,2-propylene glycol, 1,3-propylene glycol, 1,4-butanediol, and 1,6-hexanediol), alkyleneether glycols (such as diethylene glycol, triethylene glycol, dipropylene glycol, polyethylene glycol, polypropylene glycol, and polytetramethyleneether glycol), cycloaliphatic diols (such as 1,4-cyclohexane dimethanol and hydrogenated bisphenol A), bisphenols (such as bisphenol A, bisphenol F, and bisphenol S), adducts of cycloaliphatic diols described above with alkylene oxide(s) (such as ethylene oxide, propylene oxide, and butylene oxide), and adducts of the bisphenols described above with alkylene oxide(s) (such as ethylene oxide, propylene oxide, and butylene oxide). Among these, preferred are alkylene glycols having 2 to 12 carbon atoms and adducts of bisphenols with alkylene oxide(s), particularly preferred are adducts of bisphenols with alkylene oxide(s), and a combination of adducts of bisphenols with alkylene oxide(s) and alkylene glycols having 2 to 12 carbon atoms.

Examples of the trivalent or more polyols (1-2) include aliphatic polyvalent alcohols having 3 to 8 valences or more (such as glycerin, trimethylolethane, trimethylolpropane, pentaerythritol, and sorbitol), trivalent or more phenols (trisphenol PA, phenol novolacs, and cresol novolacs), and adducts of the trivalent or more polyphenols with alkylene oxide(s).

The polycarboxylic acid (2) includes, for example, a dicarboxylic acid (2-1) and a trivalent or more polycarboxylic acid (2-2). As the polycarboxylic acids, a dicarboxylic acid (2-1) alone or a mixture of a dicarboxylic acid (2-1) with a small amount of a trivalent or more polycarboxylic acid (2-2) is preferably used.

Examples of the dicarboxylic acid (2-1) include alkylene dicarboxylic acids (such as succinic acid, adipic acid, and sebacic acid), alkenylene dicarboxylic acids (such as maleic acid and fumaric acid), and aromatic dicarboxylic acids (such as phthalic acid, isophthalic acid, terephthalic acid, and naphthalenedicarboxylic acid). Among these, particularly preferred are alkenylene dicarboxylic acids having 4 to 20 carbon atoms and aromatic dicarboxylic acids having 8 to 20 carbon atoms.

Examples of the trivalent or more polycarboxylic acids (2-2) include aromatic polycarboxylic acids having 9 to 20 carbon atoms (such as trimellitic acid and pyromellitic acid). Note that as the polycarboxylic acids (2), acid anhydrides or esters of lower alkyls (such as methyl esters, ethyl esters, and isopropyl esters) of those described above, may be used to react with the polyols (1).

The reactant ratio of the polyol (1) and the polycarboxylic acid (2) is preferably 2/1 to 1/1 in terms of the equivalent ratio of hydroxyl group [OH] and carboxyl group [COOH][OH]/[COOH], more preferably 1.5/1 to 1/1, and particularly preferably 1.3/1 to 1.02/1.

Examples of the polyisocyanate (3) include aliphatic polyisocyanate (such as tetramethylene diisocyanate, hexamethylene diisocyanate, and 2,6-diisocyanatomethyl caproate), alicyclic polyisocyanate (such as isophorone diusocyanate and cyclohexylmethane diisocyanate), aromatic diusocyanate (such as trilene diisocyanate and diphenylmethane diisocyanate), aromatic aliphatic diisocyanate (such as $\alpha,\alpha,\alpha',\alpha'$-tetramethylxylylene diusocyanate), isocyanurates, and those produced by blocking the polyisocyanate described above with a phenol derivative, an oxime, or a caprolactam, or a combination of two or more of these.

The mixing ratio of the polyisocyanate (3) is preferably 5/1 to 1/1, more preferably 4/1 to 1.2/1 and particularly preferably 2.5/1 to 1.5/1, in terms of equivalent ratio of the isocyanate group [NCO] to the hydroxyl group [OH] contained in the polyester resin having hydroxyl groups ([NCO]/[OH]). When the ratio [NCO]/[OH] is more than 5/1, low temperature fixing property is sometimes degraded. When the molar ratio of [NCO] is less than 1, the urea content of the modified polyester resin becomes low and the offset resistance is sometimes degraded.

The amount of a polyisocyanate (3) constituent in the modified polyester prepolymer (A) having isocyanate groups at its terminals is preferably 0.5% by mass to 40% by mass, more preferably 1% by mass to 30% by mass and still more preferably 2% by mass to 20% by mass. When the amount is less than 0.5% by mass, hot offset resistance is degraded, and it sometimes becomes difficult to balance heat resistance/storage stability and low temperature fixing property. When it exceeds 40% by mass, low temperature fixing property is sometimes degraded.

An average number of the isocyanate group contained per molecule of the modified polyester resin (A) having isocyanate groups at its terminals is preferably one or more, more preferably 1.5 to 3 and still more preferably 1.8 to 2.5. When the average number of the isocyanate groups is less than 1, the molecular weight of the urea modified polyester resin becomes low, and hot offset resistance is sometimes degraded.

The amines (B) include diamine (B1), trivalent or more polyamine (B2), amino alcohol (B3), aminomercaptan (B4), amino acids (B5), and those obtained by blocking amino groups in B1 to B5 (B6).

Examples of the diamine (B1) include aromatic diamine (such as phenylenediamine, diethyltoluenediamine, and 4,4'-diaminodiphenylmethane), alicyclic diamine (such as 4,4'-diamino-3,3'-dimethyldicyclohexylmethane, diaminocyclohexane, and isophoronediamine), and aliphatic diamine (such as ethylene diamine, tetramethylene diamine, and hexamethylenediamine).

Examples of the trivalent or more polyamine (B2) include diethylenetriamine and triethylenetetraamine.

Examples of the amino alcohol (B3) include ethanolamine and hydroxyethylaniline.

Examples of the aminomercaptan (B4) include aminoethylmercaptan and aminopropylmercaptan.

Examples of the amino acid (B5) include aminopropionic acid and aminocaproic acid.

Examples of those obtained by blocking amino groups in (B1) to (B5) (B6) include ketimine compounds and oxazoline compounds obtained from amines in the (B1) to (B5) and ketones (acetone, methylethylketone, and methyl isobutyl ketone). Among these amines (B), B1 and a mixture of B1 and a small amount of B2 are preferred.

Furthermore, the molecular weight of the urea modified polyester can be controlled by using an elongation terminator as required. Examples of the elongation terminator include monoamines (diethylamine, dibutylamine, butylamine, and laurylamine), or those obtained by blocking them (ketimine compounds).

The ratio of the modified polyester resin containing isocyanate groups (A) to the amines (B) is preferably 1/2 to 2/1, more preferably 1/1.5 to 1.5/1 and particularly preferably 1/1.2 to 1.2/1, in terms of an equivalent ratio of isocyanate groups [NCO] in the modified polyester resin containing isocyanate groups (A) to amino groups [NHx] in the amines (B) [NCO]/[NHx]. When the ratio [NCO]/[NHx] is more than 2 or less than 1/2, the molecular weight of the urea-modified polyester resin (i) becomes small, and the hot offset resistance is sometimes degraded.

In the present invention, the modified polyester resin (i) may contain an urethane bond in addition to the urea bond. A molar ratio of the urea bond content to the urethane bond content is preferably 100/0 to 10/90, more preferably 80/20 to 20/80, and particularly preferably 60/40 to 30/70. When the molar rate of the urea bond is less than 10%, hot offset resistance is sometimes degraded.

The modified polyester resin (i) is manufactured by a one-shot method or a prepolymer method. The mass average molecular weight of the modified polyester (i) is preferably 10,000 or more, more preferably 20,000 to 10,000,000, particularly preferably 30,000 to 1,000,000. When the mass average molecular weight is less than 10,000, hot offset resistance is sometimes degraded. When the modified polyester resin (i) is used in combination with an unmodified polyester resin (ii) described below, the number average molecular weight of the modified polyester resin (i) is not particularly limited, and may be a number average molecular weight with which the above described mass average molecular weight is easily obtained. When the modified polyester resin (i) is used singularly, the number average molecular weight is preferably 20,000 or less, more preferably 1,000 to 10,000, particularly preferably 2,000 to 8,000. When the number average molecular weight is more than 20,000, glossiness when used in full-color apparatus and low temperature fixing property are sometimes degraded.

In the present invention, the modified polyester resin (i) may be used alone, or may be used in combination with an unmodified polyester resin (ii) for incorporation in a toner as toner binder components. Use of the modified polyester resin (i) in combination with the unmodified polyester resin (ii) is preferred to a single use of the modified polyester resin, since in the former case, low temperature fixing property and glossiness when used in the full-color image forming apparatus are improved. Examples of the unmodified polyester resin (ii) include, for example, a polycondensation product similar to a polyester component in the modified polyester resin (i) which is prepared by reacting a polyol (1) with a polycarboxylic acid (2), and preferred characteristics of the unmodified polyester resin (ii) is the same as those of the polyester component in the modified polyester resin (i). In order to have a good low temperature fixing property and hot offset resistance, the modified polyester (i) and the unmodified polyester (ii) are preferably at least partly compatible. Therefore, the unmodified polyester resin (ii) preferably has a composition similar to that of the polyester component of the modified polyester resin (i).

When the unmodified polyester resin (ii) is incorporated in the modified polyester resin (i), the mass ratio of the modified polyester resin (i) to the unmodified polyester resin (ii) is preferably 5/95 to 30/70, more preferably 5/95 to 25/75, and particularly preferably 7/93 to 20/80. When the mass rate of the modified polyester resin (i) is less than 5%, hot offset resistance is degraded as well as balanced achievement of heat-resistance/storage stability and low temperature fixing property sometimes becomes difficult.

—Releasing Agent—

The releasing agent is not particularly limited and can be selected from those known publicly. Examples thereof include polyolefin wax (such as polyethylene wax and polypropylene wax), long chain hydrocarbons (such as paraffin wax and Sasol wax), and carbonyl group-containing wax. Among them, carbonyl group-containing wax is particularly preferred.

Examples of the carbonyl group containing wax include polyalkanate esters (such as carnauba wax, montan wax, trimethylolpropane tribehenate, pentaerythritol tetrabehenate, pentaerythritol diacetate dibehenate, glycerine tribehenate, and 1,18-octadecanediol distearate), polyalkanol esters (such as tristearyl trimellitate and distearyl maleate), polyalkanic acid amides (such as ethylenediamine dibehenyl amide), polyalkyl amides (such as tristearyl trimellitate amide), and dialkyl ketones (such as distearyl ketone). Among these carbonyl group-containing wax, polyalkanate ester is particularly preferred.

The melting point of the wax is preferably 40° C. to 160° C., more preferably 50° C. to 120° C., and particularly preferably 60° C. to 90° C. When the melting point is less than 40° C., the wax sometimes harmfully affects the heat resistance/storage stability. When it is more than 160° C., cold offset sometimes occurs easily when fixed at a low temperature. The melt viscosity of the wax is preferably 5 cps to 1,000 cps and more preferably 10 cps to 100 cps as a measure measured at a temperature which is 20° C. higher than the melting point of the wax. When the melt viscosity is more than 1,000 cps, the wax only poorly improves hot offset resistance and low temperature fixing property The amount of the wax in the toner is preferably 40% by mass or less and more preferably 3% by mass to 30% by mass.

—Charge Controlling Agent—

A toner according to the present invention may contain a charge controlling agent as required. The charge controlling agent is not particularly limited and can be selected from those known publicly; examples thereof include nigrosine based dyes, triphenylmethane based dyes, chromium containing metal complex dyes, molybdic acid chelate pigments, rhodamine based dyes, alkoxy based amines, quaternary ammonium salts (including fluorine modified quaternary ammonium salts), alkyl amide, a simple substance of phosphorus or compounds thereof, a simple substance of tungsten or compounds thereof, fluorine based active agents, metal salts of salicylic acid and metal salts of salicylate derivatives. Specifically, the examples of the charge controlling agent include BONTRON 03 of the nigrosine based dye, BONTRON P-51 of the quaternary ammonium salt, BONTRON S-34 of the metal-containing azo dye, E-82 of oxynaphthoic acid-based metal complex, E-84 of salicylic acid-based metal complex, E-89 of phenol-based condensate (manufactured by Orient Chemical Industries Ltd.); TP-302 and TP-415 of a quaternary ammonium salt molybdenum complex (manufactured by Hodogaya Chemical Co., Ltd.); Copy Charge PSY VP2038 of the quaternary ammonium salt, Copy Blue PR of the triphenylmethane derivative, Copy Charge NEG VP2036 and Copy Charge NX VP434 of the quaternary ammonium salt (manufactured by Hoechst); LRA-901, and LR-147 which is a boron complex (manufactured by Japan Carlit Co., Ltd.); copper phthalocyanine, perylene, quinacridone, azo-based pigments, and polymer compounds having functional groups such as sulfonic acid group, carboxyl group, and quaternary ammonium salt.

The amount of the charge controlling agent in the toner varies depending on the type of the binder resin, the presence or absence of the additive used as required, and the production method of the toner including dispersion method, can not be primarily defined, but is preferably 0.1 parts by mass to 10 parts by mass and more preferably 0.2 parts by mass to 5 parts by mass relative to 100 parts by mass of the binder resin. When the amount is more than 10 parts by mass, the chargeability of the toner becomes too large, the effect of the major charge controlling agent is reduced, and an electrostatic sucking force with the developing roller is increased, sometimes resulting in the reduction of fluidity of the developer and the reduction of the image density.

Note that these charge controlling agents and releasing agents may be melt-kneaded together with a master batch and resins and may be added when components of the toner are dissolved or dispersed in an organic solvent.

—External Additive—

The external additives that are used for aiding flowability, as well as development ability and electrostatic chargeability of the toner, is not particularly limited, can be appropriately selected from those known publicly depending on the purpose, and is, for example, preferably fine inorganic particles.

The primary particle diameters of the fine inorganic particles are preferably 5 nm to 2 μm, and more preferably 5 nm to 500 nm. The specific surface areas according to a BET method are preferably 20 $m^2/g$ to 500 $m^2/g$.

The amount of the fine inorganic particles added is preferably 0.01% by mass to 5% by mass, and more preferably 0.01% by mass to 2.0% by mass relative to the amount of the toner.

The fine inorganic particles are not particularly limited and can be appropriately selected depending on the purpose; examples thereof include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

In addition to these inorganic fine particles, resin fine particles can be used as the external additive. Examples of the resin fine particles include polystyrenes obtained by soap-free emulsification polymerization, suspension polymerization, and distributed polymerization; copolymers of a methacrylic acid ester and an acrylic acid ester; polycondensation series such as silicone, benzoguanamine, and nylon; and polymer particles from thermosetting resins.

—Additional Components—

The additional components are not particularly limited, can be appropriately selected depending on the purpose, and include, for example, a flowability improver, a cleaning ability improver, a magnetic material, and a metal soap.

The flowability improver increases hydrophobicity by a surface treatment, can prevent degradation of flow characteristics or charging characteristics even at a high humidity, and includes, for example, a silane coupling agent, a silylating agent, a silane coupling agent having a fluorinated alkyl group, an organic titanate-based coupling agent, an aluminum-based coupling agent, a silicone oil, a modified silicone oil, and so forth.

The cleaning ability improver is added to the toner for removing a residual developer after transfer left on a latent electrostatic image bearing member and an intermediate transfer body, and includes for example, a fatty acid metal salt such as zinc stearate, calcium stearate, stearic acid; fine polymer particles produced by soap free emulsification polymerization such as fine polymethylmethacrylate particles and fine polystyrene particles.

The fine polymer particles preferably have relatively narrow particle size distribution and appropriately have a volume average particle diameter of 0.01 μm to 1 μm.

The magnetic material is not particularly limited, can be appropriately selected from those known depending on the purpose, and includes, for example, iron powder, magnetite and ferrite. Among these, white magnetic materials are preferable in terms of color tone.

<Method for Producing Toner>

The method for producing the toner is not particularly limited and can be appropriately selected from known methods for producing a toner depending on the purpose; examples thereof include kneading/pulverization method, polymerization method, solution suspension method, and spray granulation method. Among these, the polymerization method is particularly preferred. For the polymerization method, appropriate is a method of dissolving or dispersing in an organic solvent toner materials including at least a compound having an active hydrogen group, a polymer having a site capable of reacting with the compound having the active hydrogen group, and a pigment, reacting the solution or dispersion in an aqueous medium, and finally removing the organic solvent from the dispersion thus obtained.

When the urea modified polyester is used, a toner binder can be produced by a method described below, and so forth.

First, a polyol (1) and a polycarboxylic acid (2) is heated at a temperature in the range of 150° C. to 280° C. in the presence of an esterification catalyst such as tetrabutoxy titanate and dibutyltin oxide, and generated water is distilled away while reducing reaction pressure as required to obtain a polyester having a hydroxyl group. The polyester having a hydroxyl group is, then, reacted with a polyisocyanate (3) at a temperature in the range of 40° C. to 140° C. to obtain a modified polyester having an isocyanate group (A). Further the modified polyester (A) is reacted with an amine (B) at a temperature in the range of 0° C. to 140° C. to obtain a polyester modified with an urea bond. A solvent may be used as required when the polyester having a hydroxyl group is reacted with the polyisocyanate (3) and when the modified polyester (A) is reacted with the amine (B).

Examples of usable solvents include those that are inactive against isocyanate (3) such as aromatic solvents (such as toluene and xylene); ketones (such as acetone, methyl ethyl ketone, and methyl isobutyl ketone); esters (such as ethyl acetate); amides (dimethylformamide and dimethylacetamide); and ethers (such as tetrahydrofuran). When the polyester which is not modified with an urea bond (ii) is used in combination, the unmodified polyester resin (ii) is produced by a method similar to a method for producing the polyester having a hydroxyl group, and the unmodified polyester resin (ii) thus produced is dissolved and mixed in a solution in which the reaction for producing the modified polyester resin (i) has been completed. A dry toner can be produced by a method described below, however the production method for the dry toner is not limited to this.

The aqueous medium used in the present invention may be water alone or water in combination with a solvent miscible with water. Examples of the solvent miscible with water include alcohol (such as methanol, isopropanol, and ethylene glycol), dimethylformamide, tetrahydrofuran, celsolve compounds (such as methylcelsolve), lower ketone compounds (such as acetone and methyl ethyl ketone).

The toner particles may be prepared by reacting in an aqueous medium a dispersion composed of the modified polyester (A) having a substituent group capable of reacting with the amine (B), or by using the modified polyester (i) which has been preliminarily produced. A method for stably forming in an aqueous medium a dispersion composed of the modified polyester (i) or the modified polyester (A) having a substituent group capable of reacting includes, for example, a method of adding to an aqueous medium a composition of toner materials including the modified polyester (i) or the modified polyester (A) having a substituent group capable of reacting and of dispersing the composition by applying a shearing force. The modified polyester (A) having a substituent group capable of reacting may be mixed with a pigment, a pigment master batch, a releasing agent, a charge controlling agent, and an unmodified polyester resin, etc., which are the other toner components and hereinafter sometimes referred to as toner materials, when the modified polyester (A) having a substituent group capable of reacting and the toner materials are dispersed in an aqueous medium, however, more preferably the modified polyester (A) having a substituent group capable of reacting is dispersed in an aqueous medium with a mixture of the toner materials which has been preliminarily mixed.

A method for dispersing is not particularly limited, however, known devices based on low-speed shear method, high-speed shear method, friction method, high-pressure jet method, and ultrasonic method, etc can be used. Among these devices, a device based on a high-speed shear method is preferably used to provide a dispersion particle of diameter from 2 μm to 20 μm. When such a high-speed shear dispersing device is used, the number of revolutions per minute is not particularly limited, however, it is preferably 1,000 rpm to 30,000 rpm, and more preferably 5,000 rpm to 20,000 rpm.

Length of time for the dispersion is not particularly limited, however, it is usually preferably 0.1 min to 5 min in the case of using a batch method. The temperature at the time of dispersing is preferably high in terms of low viscosity of a dispersion composed of the modified polyester (i) or the modified polyester having a substituent group capable of reacting (A) and of easy performance of dispersing.

The amount of the aqueous medium used per 100 parts by mass of a toner composition containing the modified polyester resin (i) or the modified polyester resin having a substituent group capable of reacting (A) is preferably 50 parts by mass to 2,000 parts by mass, and more preferably 100 parts by mass to 1,000 parts by mass. When the amount is less than 50 parts by mass, the dispersion state of the toner composition is insufficient and toner particles having predetermined particle diameters sometimes can not be obtained. When the amount is more than 20,000 parts by mass, it is not economical.

Furthermore, a dispersant may be used as required. The dispersant is preferably used in terms of producing a sharp particle size distribution as well as a stable dispersion.

Examples of the dispersant used for emulsifying or dispersing an oil phase, in which the toner materials are dispersed, in a liquid containing water include anionic surfactants such as alkylbenzene sulfonate, α-olefin sulfonate, and phosphate ester; cationic surfactants such as an amine salt type (for example, alkylamine salt, aminoalcohol fatty acid derivative, polyamine fatty acid derivative, and imidazoline) and a quaternary ammonium salt surfactant (for example, alkyltrimethyl ammonium salt, dialkyldimethyl ammonium salt, alkyldimethylbenzyl ammonium salt, pyridinium salt, alkylisoquinolinium salt, benzethonium chloride); nonionic surfactants such as fatty acid amide derivative and polyalcohol derivative; and ampholytic surfactants such as alanine, dodecyldi(aminoethyl)glycine, di(octylamioethyl)glycine, and N-alkyl-N,N-dimethyl ammonium betaine.

Alternatively, with use of surfactants having a fluoroalkyl group, even in a very small amounts, the effect of the surfactant use can be improved. Examples of anionic surfactants having the fluoroalkyl group include fluoroalkylcarboxylic acid having 2 to 10 carbon atoms and a metal salt thereof, disodium perfluorooctane sulfonylglutamate, sodium 3-[ω-fluoro(C6-C11)alkyloxy]-1-(C3-C4)alkyl sulfonate, sodium 3-[ω-fluoro(C6-C8)alkanoyl-N-ethylamino]-1-propane sulfonate, fluoro(C11-C20)alkylcarboxylic acid and a metal salt thereof, perfluoro(C7-C13)alkylcarboxylic acid and a metal salt thereof, perfluoro(C4-C12)alkylsulfonic acid and a metal salt thereof, perfluorooctanesulfonic acid diethanol amide, N-propyl-N-(2-hydroxyethyl) perfluorooctanesulfonamide, a perfluoro(C6-C10)alkylsulfonamidepropyltrimethylammonium salt, a perfluoro(C6-C10)alkyl-N-ethylsulfonylglycine salt, monoperfluoro(C6-C16)alkylethylphosphate ester, and so forth.

Examples of commercialized products of the anionic surfactants having the fluoroalkyl group include SURFLON S-111, S-112, and S-113 (manufactured by Asahi Glass Co., Ltd.); FRORARD FC-93, FC-95, FC-98, and FC-129 (manufactured by Sumitomo 3M Ltd.); UNIDYNE DS-101 and DS-102 (manufactured by DAIKIN INDUSTRIES, Ltd.); MEGAFAC F-110, F-120, F-113, F-191, F-812, and F-833 (manufactured by DAINIPPON INK AND CHEMICALS, Inc.); FTOP EF-102, 103, 104, 105, 112, 123A, 123B, 306A, 501, 201, and 204 (manufactured by JEMCO Inc.); and FUTERGENT F-100 and F150 (manufactured by NEOS Co., Ltd.).

Furthermore, examples of cationic surfactants having a fluoroalkyl group include aliphatic primary amine acid, aliphatic secondary amine acid or aliphatic tertiary amine acid which has a fluoroalkyl group; and an aliphatic quaternary ammonium salt, a benzalkonium salt, a benzethonium chloride salt, a pyridinium salt, and an imidazolinium salt of perfluoro(C6-C10)alkylsulfonamidepropyltrimethyl, etc.

Examples of the commercialized products of the cationic surfactants having a fluoroalkyl group include SURFLON S-121 (manufactured by Asahi Glass Co., Ltd.), FRORARD FC-135 (manufactured by Sumitomo 3M Ltd.), UNIDYNE DS-202 (manufactured by DAIKIN INDUSTRIES, Ltd.); MEGAFAC F-150 and F-824 (manufactured by DAINIPPON INK AND CHEMICALS, Inc.); FTOP EF-132 (manufactured by JEMCO Inc.), and FUTERGENT F-300 (manufactured by NEOS Co., Ltd.).

Furthermore, examples of a dispersant of an inorganic compound that is poorly soluble in water include tricalcium phosphate, calcium carbonate, titanium oxide, colloidal silica, and hydroxyapatite.

Dispersion liquid droplets may be stabilized by using a protective macromolecule colloid. Examples of the protective macromolecule colloid include acids such as acrylic acid, methacrylic acid, α-cyanoacrylic acid, α-cyanomethacrylic acid, itaconic acid, crotonic acid, fumaric acid, and maleic acid or maleic acid anhydride; (meth)acrylic series monomer containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic acid ester, diethyleneglycol monomethacrylic acid ester, glycerin monoacrylic acid ester, glycerin monomethacrylic acid ester, N-methylolacrylamide, and N-methylolmethacrylamide; vinyl alcohols or ethers of vinyl alcohol, such as vinyl methyl ether, vinyl ethyl ether, and vinyl propyl ether; esters composed of vinyl alcohol and a compound having a carboxyl group, such as vinyl acetate, vinyl propionate, and vinyl butyrate; acrylamide, methacrylamide, and diacetoneacrylamide or a methylol compound of acrylamide, methacrylamide, and diacetoneacrylamide; acid chlorides such as acrylic acid chloride and methacrylic acid chloride; a homopolymer or a copolymer of a nitrogen-containing compound or an N-containing heterocyclic ring-containing compound, such as vinylpyridine, vinylpyrrolidone, vinylimidazole, and ethyleneimine; polyoxyethylene series such as polyoxyethylene, polyoxypropylene, polyoxyethylenealkylamine, polyoxypropylenealkylamine, polyoxyethylenealkylamide, polyoxypropylenealkylamide, polyoxyethylenenonyl phenyl ether, polyoxyethylenelauryl phenyl ether, polyoxyethylenestearyl phenyl ester, and polyoxyethylenenonyl phenyl ester; and celluloses such as methylcellulose, hydroxyethylcellulose, and hydroxypropylcellulose.

In order to remove the organic solvent from the emulsified dispersion thus obtained, employed is a method of raising gradually the temperature of the entire reaction system to completely evaporate the organic solvent in liquid drops. Also possible is a method of completely removing the water insoluble organic solvent in liquid drops to form fine toner particles by spraying the emulsified dispersion in a dried atmosphere and of simultaneously evaporating/removing the aqueous dispersant. For the dried atmosphere to which the emulsified dispersion is sprayed, generally used are gases produced by heating air, nitrogen gas, carbon dioxide gas, and a combustion gas, and especially various airflow heated at a temperature of a boiling point of the solvent having the highest boiling temperature among the solvents used or higher. The quality of gases aimed can be sufficiently obtained by a brief treatment using a spray drier, a belt drier, and a rotary kiln, etc.

When as a dispersion stabilizer a compound which is soluble in acid or alkali, such as calcium phosphate salt, is used, the calcium phosphate salt can be removed from fine particles by dissolving the calcium phosphate salt with an acid such as hydrochloric acid and washing with water. Or the calcium phosphate salt can be removed also by a decomposing procedure using an enzyme, etc. When a dispersant is used, the dispersant may be left on surfaces of toner particles, however, the dispersant is preferably cleaned and removed after the completion of the elongation and/or cross-linking reaction in terms of electrostatic chargeability of the toner.

Furthermore, for lowering the viscosity of the toner materials, a solvent capable of dissolving the modified polyester resin (i) and the modified polyester resin having a substituent group capable of reacting (A) can also be used. The solvent is preferably used in terms of producing a sharp particle size distribution. The solvent is preferably volatile having a boiling point lower than 100° C. in terms of easiness of removing the solvent.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These are used alone or in combination. Among these, an aromatic solvent such as toluene and xylene; a halogenated hydrocarbon such as methylene chloride, 1,2-dichloroethane, chloroform, and carbon tetrachloride are particularly preferred.

The amount of the solvent used per 100 parts by mass of the modified polyester having a substituent group capable of reacting (A) is preferably 300 parts by mass or less, more preferably 100 parts by mass or less, and particularly preferably 25 parts by mass to 70 parts by mass. When the solvent is used, the solvent is removed by heating under a normal or reduced pressure, after the completion of elongation and/or cross-linking reaction.

In the case of production of urea modified polyester, the length of time for the elongation and/or cross-linking reaction is selected according to the reactivity determined by compatibility of isocyanate group structures of the modified polyester having a substituent group capable of reacting (A) with the amine (B). The length of time for the elongation and/or cross-linking reaction is preferably 10 min to 40 hr, and more preferably 2 hr to 24 hr. The reaction temperature is preferably 0° C. to 150° C., and more preferably 40° C. to 98° C. Furthermore, a known catalyst may be used as required, and specifically includes, for example, dibutyltin laurate and dioctyltin laurate.

In order to remove the organic solvent from the emulsified dispersion thus obtained, employed is a method of raising gradually the temperature in the entire reaction system to completely evaporate the organic solvent in liquid drops. Also possible is a method of completely removing the water insoluble organic solvent in liquid drops to form fine toner particles by spraying the emulsified dispersion in a dried atmosphere and of simultaneously evaporating/removing the aqueous dispersant. For the dried atmosphere to which the emulsified dispersion is sprayed, generally used are gases produced by heating air, nitrogen gas, carbon dioxide gas, and a combustion gas, and especially various airflow heated at a temperature of a boiling point of the solvent having the highest boiling temperature among the solvents used or higher. The quality of gases aimed can be sufficiently obtained by a brief treatment using a spray drier, a belt drier, and a rotary kiln, etc.

When a particle size distribution at the time of emulsifying or dispersing is wide and a cleaning treatment and a drying treatment have been performed with the wide particle size distribution maintained, the particle size distribution can be controlled by classifying the particles to a desired particle size distribution. The classification can be performed by removing a fine particle portion in liquid by a cyclone, a decanter or a centrifuge. The classification may be performed after acquiring the dried powder, however, is preferably performed in a liquid in terms of efficiency. The removed fine particles or coarse particles may be recycled to the particles at the kneading step and used for the particle formation. When the removed fine particles or coarse particles are recycled, they may be wet. The dispersant used is preferably removed from the dispersion thus obtained as much as possible, the removal of the dispersant is preferably performed at the same time as the classification.

It is possible to prevent the elimination of different type particles from surfaces of the composite particles thus obtained, by fixing and melting on surfaces of the composite particles the resulting toner powder after drying and the different type particles such as fine releasing agent particles, fine charge controlling agent particles, fine fluidizer particles, and fine colorant particles by mixing the toner powder with the different type particles or applying a mechanical impact force to the powder mixture of the toner powder with the different type particles.

The specific method for applying the mechanical impact force includes method of applying the impact force to the mixture using blades which rotate at high speed, and method of placing the mixture in high speed gas flow and crashing the particles one another or the complexed particles to an appropriate crash plate by accelerating. An apparatus used for such a method includes ANG MILL (manufactured by Hosokawa Micron Ltd.), an apparatus in which a pulverization air pressure has been reduced by remodeling I TYPE MILL (manufactured by Nippon Pneumatic MFG. Co., Ltd.), HYBRIDIZATION SYSTEM (Nara Machinery Co., Ltd.), CRYPTRON SYSTEM (manufactured by Kawasaki Heavy Industries, Ltd.), and an automatic mortar.

According to such a production method, a toner can be obtained which is excellent in powder flowability and transfer efficiency and which can provide a high quality image even with a small particle diameter. Furthermore, such a toner is also excellent in low temperature fixing property and hot-offset resistance and does not cause filming or spent of the toner. The toner described above which satisfies various necessary properties, including a pulverization toner, has not been obtained yet.

—Physical Property and Other Property of Toner—

The volume-average particle diameter (DV) of a toner of the present invention is 2.0 μm to 6.0 μm, and preferably 2.0 μm to 5.0 μm. When the volume-average particle diameter is more than 6.0 μm, it becomes difficult to provide high-quality images when low toner adhesion amount is used. When the volume-average particle diameter is less than 2 μm, transfer efficiency and cleaning ability are sometimes degraded, or filming of the toner or spent of the toner to a carrier becomes easy to occur.

The ratio of the volume average particle diameter (Dv) to the number average particle diameter (Dn) of the toner is preferably 1.00 to 1.20, more preferably 1.00 to 1.15. In two-component developer, when this ratio falls within this range, variations in toner particle diameter are small in the developer even after toner consumption and toner supply have been repeated for a long time, and in addition, even after a long time stirring in the development device, excellent and stable developing ability can be ensured. Moreover, when this requirement is met in the case of one-component developer, variations in toner particle diameter decrease even after toner consumption or toner supply, and toner filming to the development roller and toner fusing to members (e.g., blade to form a thin toner film) are prevented, and in addition, even after long-time use of the development device (i.e., long-time stirring of developer), excellent and stable developing ability and images can be ensured.

The volume average particle diameter (Dv) and the number average particle diameter (Dn) of the toner were determined using a particle size measurement device ("MULTI SIZER III", manufactured by Beckman Coulter K.K.) with an aperture diameter of 100 μm, and analyzed by analysis software (BECKMAN COULTER MULTISIZER 3 Version 3.51). Specifically, into a 100 ml glass beaker, 0.5 ml of a 10% by mass surfactant (alkylbenzene sulfonate, NEOGEN SC-A; manufactured by Dai-ichi Kogyo Seiyaku Co., Ltd.) was added, 0.5 g of each of the toners was added and stirred by a micro spatula, and then to the resultant mixture, 80 ml of ion-exchange water was added. The dispersion thus obtained was subjected to a 10 minutes dispersion treatment using an ultrasonic dispersing device (W-113MK-II manufactured by HONDA ELECTRONICS CO., LTD). The particle diameters of the toner particles in the dispersion were measured using the MULTISIZER III and ISOTON III (manufactured by Beckman Coulter K.K.) as a solution for measurement. In the measurement, the toner sample dispersion was delivered by drops so that the concentration indicated by the device was 8±2%. In this measurement method, it is important to control the concentration of the dispersion to 8±2% from the viewpoint of reproducibility of the measurement of the particle diameter. As far as the concentration is in this range, inaccuracy of the particle diameter does not occur.

The peak molecular weight of the toner is preferably 1,000 to 30,000, and more preferably 1,500 to 10,000, and particularly preferably 2,000 to 8,000. When the peak molecular weight is less than 1,000, heat resistance/storage stability is sometimes degraded. When the peak molecular weight is more than 30,000, low temperature fixing property is sometimes degraded.

The peak molecular weight of the toner in the present invention is specifically determined according to the following procedure.

—Measurement of Peak Molecular Weight of Toner—

Gel permeation chromatography (GPC) device: GPC-8220GPC (manufactured by TOSOH CORPORATION)

Column: TSKgel SuperHZM-H; 15 cm, 3 channel (manufactured by TOSOH CORPORATION)

Temperature: 40° C.

Solvent: THF

Flow rate: 0.35 ml/min

GPC sample: 0.4 ml sample (0.15% conc.)

Pre-treatment of sample: Toner is dissolved in stabilizer-containing THF (manufactured by Wako Pure Chemical Industries, Ltd.) to a concentration of 0.15%, and the solution is filtrated through a 0.2 em-pore filter. The filtrate is used as sample. GPC is performed by injecting 100 Ill of the THF sample solution in the column.

For the molecular weight measurement of the sample, the molecular weight distribution of the sample was calculated based on the relationship between the logarithm values and the counts of the calibration curve prepared from several monodispersed polystyrene standard samples. As the standard polystyrene samples for the preparation of the calibration curve, Showdex STANDARD series (Std. No. S-7300, S-210, S-390, S-875, S-1980, S-10.9, S-629, S-3.0, and S-0.580; manufactured by SHOWA DENKO K.K.) and toluene were employed. A refractive index (RI) detector was used as a detector.

The hydroxyl group value of the toner is preferably 5 mgKOH/g or more, more preferably 10 mgKOH/g to 120 mgKOH/g, and particularly preferably 20 mgKOH/g to 80 mgKOH/g. When the hydroxyl group value is less than 5 mgKOH/g, balanced achievement of heat resistance/storage stability and low temperature fixing property sometimes becomes difficult.

The acid value of the toner is preferably 1 mgKOH/g to 40 mgKOH/g, more preferably 5 mgKOH/g to 30 mgKOH/g, and particularly preferably 15 mgKOH/g to 28 mgKOH/g. When the toner has some acid value, the toner tends to be negatively charged, is and becomes to have an increased affinity for paper at the time of fixing, resulting in strong fixing power.

Specifically, the acid value (AV) and the hydroxyl group value (OHV) in the toner are measured in the following manner:

Measurement instrument: automatic potentiometric titrator DL-53 Titrator (manufactured by Metller-Toledo International Inc.)

Electrode: DG113-SC (manufactured by Metller-Toledo International Inc.)
Analysis software: LabX Light Version1.00.000
Calibration: mixture solvent of 120 ml toluene and 30 ml ethanol is used
Measurement temperature: 23° C.
Measurement conditions are as follows:
Stir
Speed[%] 25
Time[s] 15
EQP Titration
Titrant/Sensor
Titrant $CH_3ONa$
Concentration[mol/L] 0.1
Sensor DG115
Unit of measurement mV
Predispensing to volume
Volume[mL] 1.0
Wait time[s] 0
Titrant addition Dynamic
dE(set)[mV] 8.0
dV(min)[mL] 0.03
dV(max)[mL] 0.5
Measure mode Equilibrium controlled
dE[mV] 0.5
dt[s] 1.0
t(min)[s] 2.0
t(max)[s] 20.0
Recognition
Threshold 100.0
Steepest jump only No
Range No
Tendency None
Termination
At maximum volume[mL] 10.0
At potential No
At slope No
After number EQPs Yes
n=1
comb. Termination conditions No
Evaluation
Procedure Standard
Potential 1 No
Potential 2 No
Stop for reevaluation No —Measurement Method of Acid Value—

Acid value measurement was made in accordance with the method described in JIS K0070-1992 as follows:

Sample preparation: 0.5 g of toner (equivalent to 0.3 g of soluble components in ethyl acetate) was added to 120 ml of toluene and dissolved by stirring for about 10 hours at room temperature (23° C.). Further 30 ml of ethanol was added to prepare a sample solution. The acid value can be measured using the above-mentioned instrument. However, the acid value was obtained as follows:

The sample solution was titrated with N/10 (0.1M) potassium hydroxide solution and alcohol solution previously standardized. Based on the consumption amounts of the alcohol solution and potassium hydroxide solution, the acid value was calculated using the following equation:

Acid value=KOH (mol)×N×56.1/sample mass (where N is a factor of N/10 KOH)

Measurement Method of Hydroxyl Group Value—

Hydroxyl group value measurement was made in accordance with the method described in JIS K0070-1966 as follows:

A sample (0.5 g) is weighed out precisely and put into a 100-ml measuring flask, into which 5 ml of an acetylating reagent is precisely added. Subsequently the resultant mixture is heated in a bath at 100° C.±5° C. The measuring flask is removed from the bath after heating for 1 or 2 hours, cooled, then water is added into the measuring flask, and the flask is shaken to decompose acetic anhydride. In order to decompose acetic anhydride completely, the measuring flask is again heated in the bath for 10 min or more, and cooled, then the wall of the flask is sufficiently washed with an organic solvent. The resultant solution is titrated potentiometrically with a 0.5-N ethyl alcohol solution of potassium hydroxide using the electrode to calculate the hydroxyl value.

The glass transition temperature of the toner is preferably 40° C. to 70° C. When the glass transition temperature is less than 40° C., it may result in poor heat resistance/storage stability. When the glass transition temperature is greater than 70° C., it may result in insufficient low-temperature fixing ability.

Specifically, the glass transition temperature (Tg) is measured according to the following procedure. Measurement was made under the following measurement conditions using TA-60WS and DSC-60, manufactured by Shimadzu Corporation, as measurement instruments.

[Measurement Conditions]
Sample container: aluminum sample pan (with lid)
Sample amount: 5 mg
Reference: aluminum sample pan (10 mg of alumina)
Atmosphere: nitrogen (flow rate: 50 ml/min)
Temperature conditions
Start temperature: 20° C.
Heating rate: 10° C./min
Finish temperature: 150° C.
Retention time: NO
Cooling rate: 10° C./min
Finish temperature: 20° C.
Retention time: NO
Heating rate: 10° C./min
Finish temperature: 150° C.

Analysis was carried out on the measurement results using data analysis software TA-60 version1.52 (manufactured by Shimadzu Corporation). Analysis procedure is as follows: Using the peak analysis function of the software, a segment of the DrDSC curve (differential DSC curve at the second heating), which segment corresponds to a temperature range of within ±5° C. from the maximum peak locating at the lowest temperature side, is specified for determination of the peak temperature. Subsequently, using the peak analysis function of the software, the maximum heat absorption temperature is found from the DSC curve in a range within ±5° C. of the peak temperature. The obtained temperature corresponds to the glass transition temperature (Tg) of the toner.

The color of the toner is not particularly limited, can be appropriately selected depending on the purpose, and can be at least one selected from black toner, cyan toner, magenta toner, and yellow toner. The toner for each color can be obtained by appropriately selecting the type of the colorant described above, however, is preferably a color toner.

A toner of the present invention achieves a sufficient image density with a normal addition amount of pigment, without the necessity of adding a large amount of pigment, even with a low toner adhesion amount, decreases a toner consumption rate, thereby contributing to a solution to environmental problems, achieves a high quality image, enlarges the color reproduction range, and therefore can be used suitably in various fields, more suitably in an electrographic image forming, and particularly suitably in a developer, a toner container, a process cartridge, an image forming apparatus, and an image forming method.

(Developer)

A developer of the present invention is a two-component developer composed of the toner of the present invention and a carrier. When used in the two-component developer, the toner is mixed with a magnetic carrier. The amount of the toner per 100 parts by mass of the carrier in the developer is preferably 1 part by mass to 10 parts by mass.

Examples of the magnetic carrier include an iron powder having particle diameters of about 20 μm to 200 μm, a ferrite powder, a magnetite powder, a carrier produced by coating surfaces of the magnetic carrier cores with a resin. Among these, a coated carrier with a resin is particularly preferred.

Examples of the resins for coating the coated carrier include urea-formaldehyde resins, melamine resins, benzoguanamine resins, urea resins, polyamide resins, epoxy resins, polyvinyl resins, polyvinylidene resins, acrylic resins, polymethylmethacrylate resins, polyacylonitrile resins, polyvinyl acetate resins, polyvinyl alcohol resins, polyvinyl butyral resins, polystyrene resins, styrene-acrylic copolymer resins, polyvinyl chloride resins, polyethylene terephthalate resins, polybutylene terephthalate resins, polycarbonate resins, polyethylene resins, polyvinyl fluoride resins, polyvinylidene fluroride resins, polytrifluoroethylene resins, polyhexafluoropropylene resins, copolymers of vinylidene fluoride and acrylic monomer, copolymers of vinylidene fluoride and vinyl fluoride, fluoroterpolymers such as terpolymers of tetrafluoroethylene, vinylidene fluoride, and non-fluoro monomer, and silicone resins.

The resin may contain conductive powder or the like as required; examples of the conductive powder include metal powder, carbon black, titanium oxide, tin oxide, and zinc oxide. The average particle diameter of these conductive powders is preferably 1 μm or less. If the average particle diameter is greater than 1 μm, it may be difficult to control the electrical resistance.

<Toner Container>

A toner container used in the present invention contains therein the toner or the developer of the present invention.

The container for the toner container is not particularly limited and can be appropriately selected from those known in the art; preferable examples thereof include those having a toner container body and a cap.

The size, shape, structure, material, etc., of the toner container body are not particularly limited and can be appropriately selected depending on the intended purpose. The shape is preferably a cylindrical shape, for example. It is particularly preferable that a spiral ridge be formed on the inner surface and the content or toner moves toward the discharging port when rotated, and the spiral partly or entirely serves as a bellow.

The material of the toner container body is not particularly limited and preferably made of material that offers good dimensional accuracy. The material of the toner container body is preferably resins, for example. Among them, polyester resins, polyethylene resins, polypropylene resins, polystyrene resins, polyvinyl chloride resins, polyacrylic acid resins, polycarbonate resins, ABS resins, polyacetal resins are preferable.

The toner container is easy to be stored and delivered and has excellent handleability, as well as is preferably used with a process cartridge or an image forming apparatus by being detachably mounting thereto for toner supply.

<Process Cartridge>

A process cartridge used in the present invention includes at least a latent electrostatic image bearing member configured to bear a latent electrostatic image thereon, and a developing unit configured to develop the latent electrostatic image on the latent electrostatic image bearing member with a developer to form a visible image. The process cartridge further contains other units appropriately selected as required.

The developing unit includes at least a developer storage for storing the aforementioned toner or developer of the present invention and a developer bearing member configured to hold and transfer the toner or developer stored in the developer storage, and may further include a layer thickness control member for controlling the thickness of toner layer formed on the developer bearing member.

The process cartridge can be detachably mounted to a variety of electrophotographic image forming apparatuses, and is preferably detachably mounted to the image forming apparatus of the present invention, which will be described later.

The process cartridge includes, for example, as shown in FIG. 1, a built-in latent electrostatic image bearing member 101, a charging unit 102, a developing unit 104, a transfer unit 108, and a cleaning unit 107, and, where necessary, further includes additional units. In FIG. 1 reference numeral 103 denotes exposure by means of an exposure unit, and 105 denotes a recording medium.

Next, the image forming process by means of the process cartridge shown in FIG. 1 will be described. A latent electrostatic image corresponding to an exposed image is formed on the surface of the latent electrostatic image bearing member 101 by charging using the charging unit 102 and exposing using exposure 103 of the exposure unit (not shown), with the latent electrostatic image bearing member 101 being rotated in an arrow direction. The latent electrostatic image is developed using the toner by means of the developing unit 104 to form a visible image, which is then transferred to the recording medium 105 by means of the transfer unit 108 and printed out. Subsequently, the surface of the latent electrostatic image bearing member 101 after image transfer is cleaned by means of the cleaning unit 107, further followed by charge elimination by means of a charge eliminating unit (not shown). The above operation is carried out repeatedly.

(Image Forming Method and Image Forming Apparatus)

An image forming method of the present invention includes at least a latent electrostatic image forming step, a developing step, a transferring step and a fixing step, and further includes additional step(s) appropriately selected as required; examples include, for example, a charge eliminating step, a cleaning step, a recycling step, and a controlling step.

An image forming apparatus used in the present invention includes at least a latent electrostatic image bearing member, a latent electrostatic image forming unit, a developing unit, a transfer unit, and a fixing unit, and further includes additional unit(s) appropriately selected as required; examples include, for example, a charge eliminating unit, a cleaning unit, a recycling unit, and a controlling unit.

The latent electrostatic image forming is a step of forming a latent electrostatic image on a latent electrostatic image bearing member.

The material, shape, structure, size, etc., of the latent electrostatic image bearing member (hereinafter may be referred to as "electrophotographic photoconductor", "photoconductor", or "image bearing member") are not specifically limited and can be appropriately selected from those known in the art.

The photoconductor is preferably drum-shaped, and is, for example, an inorganic photoconductor made of amorphous silicon, selenium or the like, or an organic photoconductor made of polysilane, phthalopolymethine, or the like. Among these, amorphous silicon is preferred in terms of achieving long life.

The latent electrostatic image formation is carried out, for example, by imagewise exposure of a surface of the latent electrostatic image bearing member right after uniformly charging the entire surface of the latent electrostatic image bearing member. This is performed by means of the latent electrostatic image forming unit. The latent electrostatic image forming unit includes at least a charging unit configured to uniformly charge the surface of the latent electrostatic image bearing member, and an exposure unit configured to imagewisely expose the surface of the latent electrostatic image bearing member.

The charging is carried out, for example, by applying voltage to the surface of the photoconductor by means of the charging unit.

The charging unit is not particularly limited and can be appropriately selected depending on the intended purpose. Examples of the charging unit include conventional contact-charging units equipped with a conductive or semiconductive roller, blush, film or rubber blade, and non-contact-charging units utilizing corona discharge such as a corotron or a scorotoron.

The exposure is carried out, for example, by imagewise exposure of the surface of the photoconductor by means of the exposure unit.

The exposure unit is not particularly limited as long as predetermined imagewise exposure is possible on the surface of the latent electrostatic image bearing member that has been charged by the charging unit, and can be appropriately selected depending on the intended purpose. Examples of the exposure unit are various exposure units such as an optical copy unit, a rod-lens-array unit, an optical laser unit, an optical liquid crystal shatter unit, and the like In the present invention, a backlight system may be applied for the exposure, in which imagewise-exposure is carried out from the back side of the photoconductor.

—Developing and Developing Unit—

The developing is a step of forming a visible image by developing a latent electrostatic image using the toner or developer of the present invention.

The visible image formation may be performed by developing a latent electrostatic image using the toner or developer of the present invention by means of the developing unit.

The developing unit is not particularly limited and may be appropriately selected from known developing units accordingly as long as it can perform developing using the toner or the developer of the present invention. Preferred examples of the developing unit include a developing unit containing the toner or developer of the present invention, and at least a developing device which can provide the toner or developer to the latent electrostatic image in a contact manner or non-contact manner. The developing device is preferably equipped with the toner container described above.

The developing device may be of dry development type or wet development type and may be a developing device for single color or multicolor; a preferred is, for example, a developing device which has a stirrer for charging the toner or developer by friction stirring, and a rotatable magnet roller.

In the developing device, the toner and carrier are mixed and thereby the toner is electrically charged by friction and toner particles are retained in the form of magnetic brush on a surface of the rotating magnet roller. Since the magnet roller is positioned near the latent electrostatic image bearing member (photoconductor), some toner particles constructing the magnetic brush formed on the surface of the magnet roller move to the surface of the latent electrostatic image bearing member (photoconductor) by electric attraction, resulting in development of the latent electrostatic image to form a visible image on the surface of the latent electrostatic image bearing member (photoconductor).

The developer to be contained in the developing device is a developer containing the toner of the present invention, which is preferably a two-component developer.

—Transferring and Transfer Unit—

The transferring step is a step of transferring a visible image to a recording medium, and it preferably uses an intermediate transfer member so that a visible image is transferred primarily on the intermediate transfer member and then the visible image is transferred secondarily to the recording medium. More preferably, the transferring step consists of a first transferring step in which a visible image, formed using toner of two or more colors or preferably full-color toner, is transferred to the intermediate transfer member to form a complex image thereon, and a secondary transferring step in which the complex image is transferred to a recording medium.

The transferring step can be performed by charging the latent electrostatic image bearing member (photoconductor) by means of a transfer charging device, which is achieved by the transfer unit. A preferred embodiment of the transfer unit is that it includes a primary transfer unit in which a visible image is transferred to the intermediate transfer member to form a complex image thereon, and a secondary transfer unit in which the complex image is transferred to a recording medium.

The intermediate transfer member is not particularly limited and can be appropriately selected from known transfer members depending on the intended purpose; preferred examples include a transfer belt.

The transfer unit (the primary transfer unit and secondary transfer unit) preferably includes at least a transfer device configured to transfer the visible image formed on the latent electrostatic image bearing member (photoconductor) to a recording medium by means of electrical charge. There may be only one transfer unit or may be two or more transfer units.

Examples of the transfer device include a corona transfer device utilizing corona discharge, a transfer belt, a transfer roller, a pressure-transfer roller, and an adhesion-transfer device.

The recording medium is not particularly limited and can be appropriately selected from known recording media (recording paper sheets).

The fixing is a step of fixing the visible image transferred on a recording medium using a fixing device. The fixing step may be performed for each of the toner images having different colors when they are transferred to the recording medium, or may be performed at a time for laminated toner images.

The fixing device is not particularly limited and can be appropriately selected depending on the intended purpose, with a preferred example being a conventional heating and pressurizing unit. The heating and pressurizing unit is, for example, a combination of a heating roller and a pressurizing roller, a combination of a heating roller, a pressurizing roller and an endless belt.

In general, the heating temperature of the heating and pressurizing unit is preferably 80° C. to 200° C.

In the present invention, for example, a conventional photo-fixing device can be used along with or in place of the fixing step and fixing unit depending on the intended purpose.

The charge eliminating step is a step of applying a charge-eliminating bias to the charged photoconductor for charge removal. This is suitably performed by the charge eliminating unit.

The charge eliminating unit is not particularly limited as long as a charge eliminating bias is applied to the charged photoconductor for charge removal, and can be appropriately selected from conventional charge eliminating devices depending on the intended purpose. A suitable example thereof is a charge eliminating lamp.

The cleaning step is a step of removing residual toner particles on the photoconductor. This is suitably performed by means of the cleaning unit.

The cleaning unit is not particularly limited as long as such residual electrophotographic toner particles on the photoconductor can be removed, and can be appropriately selected from conventional cleaners depending on the intended purpose; examples include a magnetic blush cleaner, an electrostatic brush cleaner, a magnetic roller cleaner, a blade cleaner, a blush cleaner, and a wave cleaner.

The recycling step is a step of recycling toner collected in the cleaning step to the developing unit. This is suitably performed by means of the recycling unit.

The recycling unit is not particularly limited and can be appropriately selected from conventional conveyance systems.

The controlling is a step of controlling each of the aforementioned steps. This is suitably performed by means of the control unit.

The control unit is not particularly limited as long as it is capable of controlling the operation of each of the aforementioned units, and can be appropriately selected depending on the intended purpose; examples include such devices as sequencers and computers.

An aspect of carrying out an image forming method according to the present invention by the image forming apparatus will be described below with a reference to FIG. 2. An image forming apparatus 100 shown in FIG. 2 includes a photoconductor drum 10 as the latent electrostatic image bearing member, a charging roller 20 as the charging unit, an exposing unit 30 as the exposing unit, a developer unit 40 as the developing unit, an intermediate transfer member 50, a cleaning unit 60 as a cleaning unit having a cleaning blade, and a charge eliminating lamp 70 as the charge eliminating unit.

Figure 2:
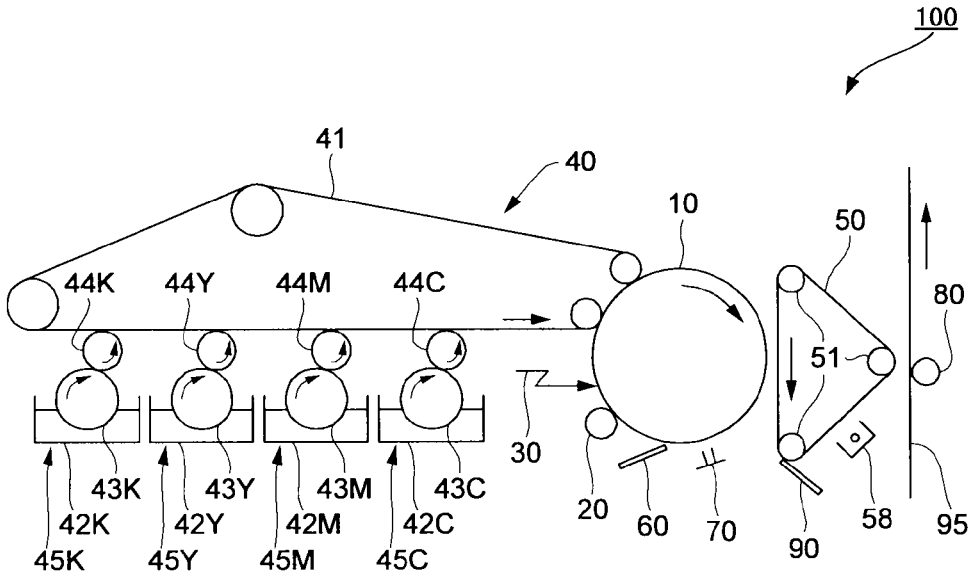
FIG. 2 is a schematic illustration showing an example of an image forming apparatus of the present invention, which is used for carrying out an image forming method of the present invention.

The intermediate transfer member 50 is an endless belt, and is disposed to be movable in a direction indicated by an arrow shown in FIG. 2, by three rollers 51 disposed therein, around which the endless belt is stretched (put). A part of (Some of) the three rollers 51 also function as a transfer-bias roller capable of applying a predetermined transfer bias (primary-transfer bias) to the intermediate transfer member 50. A cleaning blade 90 for the intermediate transfer member is disposed near the intermediate transfer member 50. Moreover, a transfer roller 80 as the transfer unit, capable of applying the transfer bias for transferring (secondary transfer) a visible image (toner image) to a recording medium 95, is disposed facing the intermediate transfer member 50. Around the intermediate transfer member 50, a corona charger 58 for applying the electric charge to the visible image on the intermediate transfer member 50 is disposed between a contact portion of the latent electrostatic image bearing member 10 and the intermediate transfer member 50, and a contact portion of the intermediate transfer member 50 and the recording medium 95, in a direction of rotation of the intermediate transfer member 50.

The developer unit 40 includes a developing belt 41 as a developer bearing member, a black developing unit 45K, a yellow developing unit 45Y, a magenta developing unit 45M, and a cyan developing unit 45C provided around the developing belt 41. The black developing unit 45K includes a developer accommodating section 42K, a developer supplying roller 43K, and a developing roller 44K. The yellow developing unit 45Y includes a developer accommodating section 42Y, a developer supplying roller 43Y, and a developing roller 44Y. The magenta developing unit 45M includes a developer accommodating section 42M, a developer supplying roller 43M, and a developing roller 44M. The cyan developing unit 45C includes a developer accommodating section 42C, a developer supplying roller 43C, and the developing roller 44C. Moreover, the developing belt 41 is an endless belt, and is rotatably stretched around a plurality of belt rollers. A part of the developing belt 41 is in contact with the latent electrostatic image bearing member 10.

In the image forming apparatus 100 shown in FIG. 2, for example, the charging roller 20 uniformly charges the photoconductor drum 10. The exposing unit 30 carries out an image-wise exposing on the photoconductor drum 10, and forms a latent electrostatic image. The latent electrostatic image formed on the photoconductor drum 10 is developed by supplying the toner from the developer unit 40, and a visible image (toner image) is formed. The visible image (toner image) is transferred to the intermediate transfer member 50 (primary transfer) by a power voltage applied by the rollers 51, and further transferred to the transfer paper 95 (secondary transfer). As a result of this, a transfer image is formed on the transfer paper 95. The toner remained on the photoconductor 10 is removed by the cleaning unit 60, and the charging of the photoconductor is eliminated once by the charge eliminating lamp 70.

Figure 3:
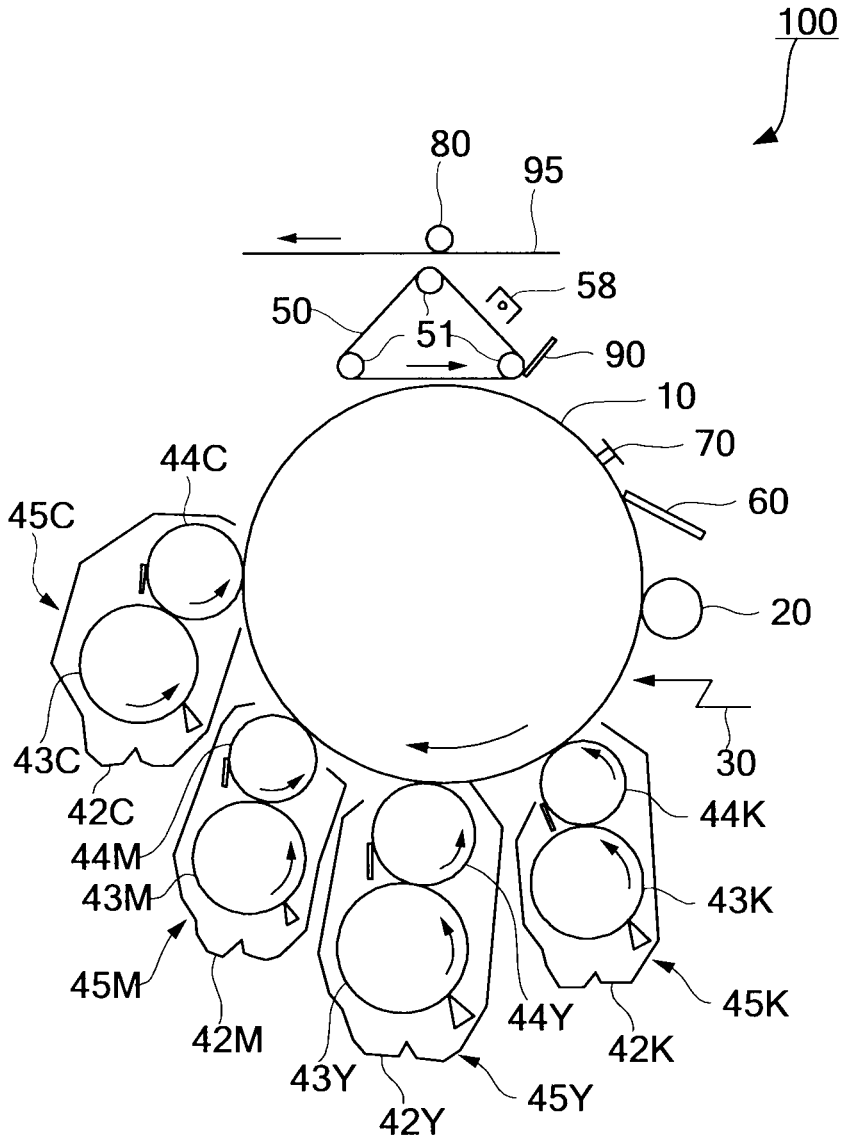
FIG. 3 is a schematic illustration showing another example of an image forming apparatus of the present invention, which is used for carrying out an image forming method of the present invention.

Another aspect of carrying out the image forming method according to the present invention by the image forming apparatus will be described below with a reference to FIG. 3. An image forming apparatus 100 shown in FIG. 3 has a structure similar to a structure of the image forming apparatus 100 shown in FIG. 2, except that the developing belt 41 is not provided, and that the black developing unit 45K, the yellow developing unit 45Y, the magenta developing unit 45M, and the cyan developing unit 45C are disposed to face directly, around the photoconductor 10, and have a similar action and effect to the image forming apparatus 100 shown in FIG. 2. In FIG. 3, same reference numerals as in FIG. 2 are assigned to components which are same as in FIG. 2.

Figure 4:
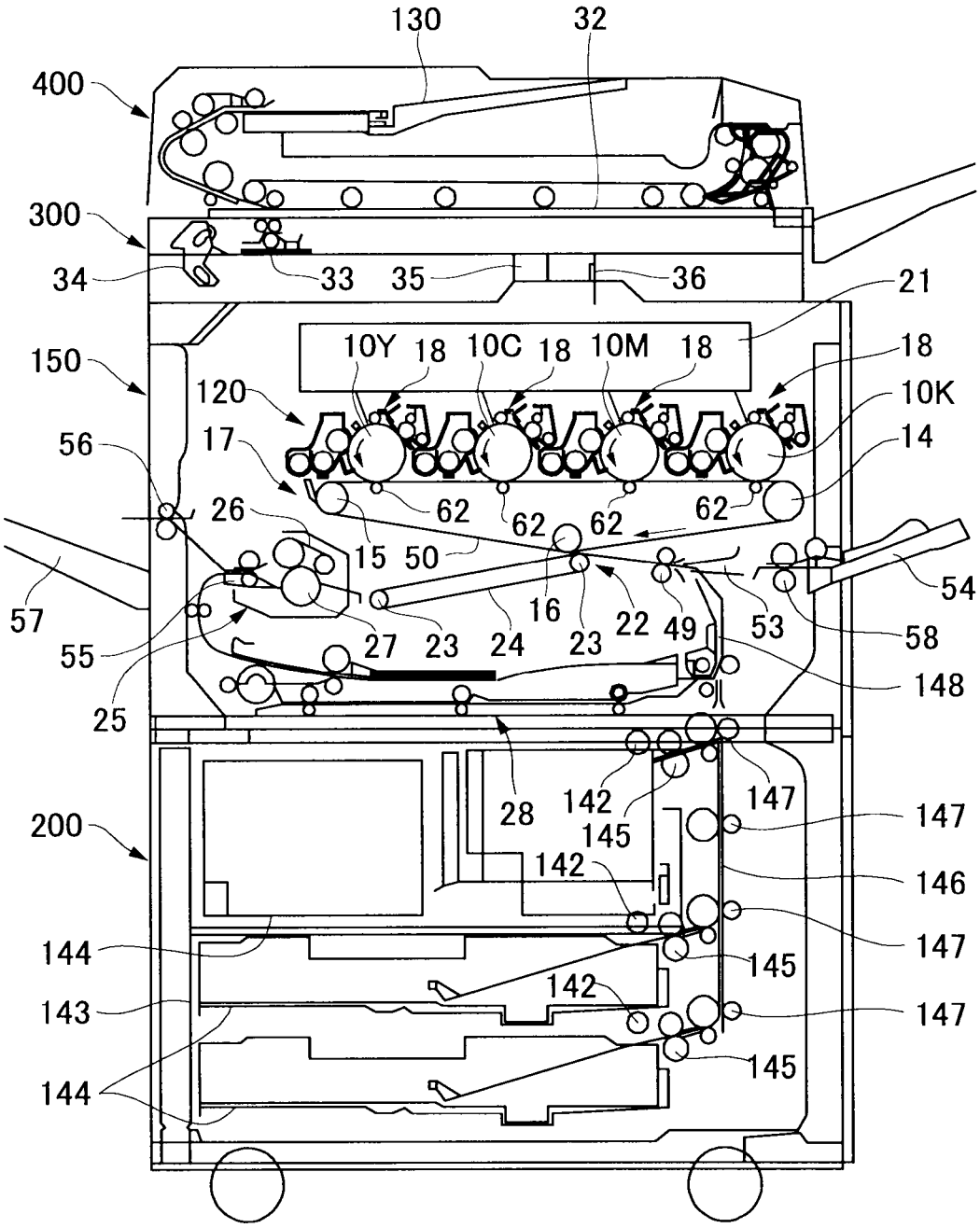
FIG. 4 is a schematic illustration showing an example of an image forming apparatus of the present invention (tandem type color image forming apparatus), which is used for carrying out an image forming method of the present invention.

Another aspect of carrying out the image forming method according to the present invention by the image forming apparatus will be described below with a reference to FIG. 4. A tandem image forming apparatus shown in FIG. 4 is a tandem color image forming apparatus. The tandem image forming apparatus includes a copier main body 150, a paper feeding table 200, a scanner 300, and an automatic document feeder (ADF) 400.

The copier main body 150 is provided with the intermediate transfer member 50 in the form of an endless belt, at the central portion. The intermediate transfer member 50 is stretched over supporting rollers 14, 15, and 16, and is rotatable in a clockwise direction in FIG. 4. An intermediate transfer member cleaning unit 17 for removing the toner remained on the intermediate transfer member 50 is disposed near the supporting roller 15. A tandem developer unit 120 in which image forming units 18 for yellow, cyan, magenta, and black are arranged facing, is disposed along the transporting direction thereof, on the intermediate transfer member 50 which is stretched over supporting rollers 14, 15, and 16. An exposing unit 21 is disposed near the tandem developer unit 120. A secondary transfer unit 22 is disposed on a side of the intermediate transfer member, opposite to a side at which the tandem developer unit 120 is disposed. In the secondary transfer unit 22, a secondary transfer belt 24 which is an endless belt is stretched over a pair of rollers 23, a transfer paper which is to be transported on the secondary transfer belt 24 and the intermediate transfer member 50 can make a mutual contact. A fixing unit 25 is disposed near the secondary transfer unit 22. The fixing unit 25 includes a fixing belt 26, which is an endless belt, and a pressure roller 27, which is disposed so as to press against the fixing belt 26.

In the tandem image forming apparatus, a sheet reversing unit 28 for reversing the transfer paper for carrying out the image formation on both sides of the transfer paper is disposed near the secondary transfer unit 22 and the fixing unit 25.

Next, formation of a full color image (color copy) using the tandem developer unit 120 will be described below. First, a document is set on a document feed tray 130 of the automatic document feeder (ADF) 400, or the document is set on a contact glass 32 of the scanner 300 upon opening the automatic document feeder 400, and the automatic document feeder 400 is closed.

When a start switch (not shown) is pressed, in a case of setting the document in the automatic document feeder 400, after the document is transported and moved on to the contact glass 32, whereas in a case of setting the document on the contact glass 32, immediately after the document is set, the scanner 300 is driven and a first scanning component 33 and a second scanning component 34 run. At this time, due to the first scanning component 33, light from a light source is irradiated and a light reflected from a document surface is reflected at a mirror in the second scanning component 34. The light reflected at the second scanning component 34 is passed through an image forming lens 35 and received at a reading sensor 36. Thus the color document (color image) is read and let to be image information of black, yellow, magenta, and cyan (colors).

Figure 5:
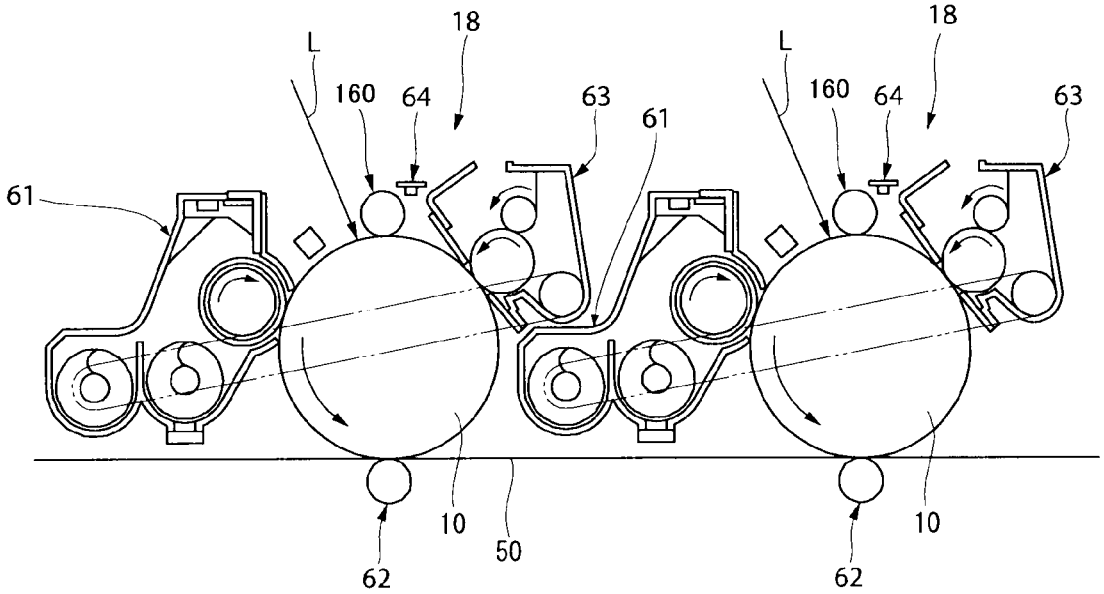
FIG. 5 is an enlarged partial schematic illustration of the image forming apparatus shown in FIG. 4.

Color information of each of black, yellow, magenta, and cyan is transmitted to each image forming unit 18 (image forming unit for black, image forming unit for yellow, image forming unit for magenta, and image forming unit for cyan) in the tandem developer unit 120, and a toner image of each of black, yellow, magenta, and cyan is formed in the respective image forming unit. In other words, each image forming unit 18 (image forming unit for black, image forming unit for yellow, image forming unit for magenta, and image forming unit for cyan) in the tandem developer unit 120, as shown in FIG. 5, includes photoconductors 10 (photoconductor for black 10K, photoconductor for yellow 10Y, photoconductor for magenta 10M, and photoconductor for cyan 10C), a charging unit 160 which uniformly charges the photoconductor 10, an exposing unit which exposes the photoconductor image-wise corresponding to each color image based on each color information (L in FIG. 5), and which forms a latent electrostatic image corresponding to each color image on the photoconductor, a developer unit 61 which develops the latent electrostatic image by each toner (black toner, yellow toner, magenta toner, and cyan toner), and forms a toner image by each color toner, a transfer charger 62 for transferring the toner images to the intermediate transfer member 50, a cleaning unit 63, and a charge eliminating unit 64, and it is possible to form a single color image of each color (black image, yellow image, magenta image, and cyan image) based on the image information of the respective color. The black image, the yellow image, the magenta image, and the cyan image formed in such manner, (in other words) the black image formed on the photoconductor for black 10K, the yellow image formed on the photoconductor for yellow 10Y, the magenta image formed on the photoconductor for magenta 10M, and the cyan image formed on the photoconductor for cyan 10C are transferred one after another (primary transfer) to the intermediate transfer member 50 which is rotated by supporting rollers 14, 15, and 16. Next, the black image, the yellow image, the magenta image, and the cyan image are superimposed on the intermediate transfer member 50, and a composite color image (color transfer image) is formed.

On the other hand, in the paper feeding table 200, one of paper feeding rollers 142 is selectively rotated, and a sheet (recording paper) is let out from one of paper feeding cassettes 144 which are provided in multiple stages in a paper bank 143. One paper at a time is separated by a separating roller 145, and is sent to a paper feeding path 146. Further, the paper is transported (carried) by a transporting roller 147, then guided to a paper feeding path 148 inside the copier main body 150, and is stopped by allowing to abut against a resist roller 49. Or, the paper feeding roller 142 is rotated and sheets (recording papers) in a bypass tray 54 are let out. One sheet at a time is separated by the separating roller 145 and is inserted (put) into a bypass paper feeding path 53, and is stopped in the same manner by allowing to abut against the resist roller 49. The resist roller 49 is generally used upon connecting to the ground, but may be used in a state of a bias applied thereon for removing paper dust of the sheet. Further, the resist roller 49 is rotated upon matching the timing with the composite color image (color transfer image) which is combined on the intermediate transfer member 50, and the sheet (recording paper) is sent between the intermediate transfer member 50 and the secondary transfer unit 22. By transferring (secondary transfer) the composite color image (color transfer image) to the sheet (recording paper) by the secondary transfer unit 22, the color image is transferred to and formed on the sheet (recording paper). The toner remained on the intermediate transfer member 50 after transferring the image is cleaned by the intermediate transfer member cleaning unit 17.

The sheet (recording paper) with the color image transferred to and formed thereon is transported by the secondary transfer unit 22 and is sent to the fixing unit 25. In the fixing unit 25, by heat and pressure, the composite color image (color transfer image) is fixed on the sheet (recording paper). After fixing the composite color image on the sheet, the sheet (recording paper) is switched (shifted) by a switch blade 55, and is discharged by a discharge roller 56. The discharged sheet is stacked in a paper discharging tray 57. After switching (shifting) the sheet by the switch blade 55, the sheet is reversed (inverted) by the sheet reversing unit 28, and is again guided to a transfer position. After recording an image also on a reverse surface, the sheet is discharged by the discharge roller 56, and is stacked in the paper discharging tray 57.

In the image forming method, the image forming apparatus, and the process cartridge according to the present invention, since the toner of the present invention which achieves a sufficient image density with a normal addition amount of pigment, without the necessity of adding a large amount of pigment, even with a low toner adhesion amount, decreases a toner consumption rate, thereby contributing to a solution to environmental problems, achieves high image quality, and can enlarge color reproduction range, is used, a high quality images can be obtained efficiently.

EXAMPLES

The present invention will be further specifically described below by the examples. However, the present invention is not restricted to these examples.

Example 1

Preparation of Toner 1

—Preparation of Fine Particle Dispersion 1—

In a reaction vessel equipped with a stirrer and a thermometer, placed were 683 parts by mass of water, 11 parts by mass of a sodium salt of ethylene oxide methacrylate adduct sulfuric ester ("ELEMINOL RS-30 manufactured by Sanyo Chemical Industries, Ltd.), 83 parts by mass of styrene, 83 parts by mass of methacrylic acid, 110 parts by mass of butyl acrylate, and 1 part by mass of ammonium persulfate, and the mixture was stirred at 400 rpm (rotations per minute) for 15 minutes to yield a white emulsion. The emulsion was heated and the temperature was raised up to a system temperature of 75° C., and allowed to react for five hours. Next, 30 parts by mass of 1% by mass ammonium persulfate aqueous solution was added. The mixture was aged for five hours at 75° C. and an aqueous dispersion of a vinyl resin (a copolymer of styrene-methacrylic acid-butyl acrylate-sodium salt of ethylene oxide methacrylate adduct sulfuric ester) [fine particle dispersion 1] was prepared.

The volume average particle diameter of the fine particles in the [fine-particles dispersion 1] thus obtained, when measured by a particle-size distribution analyzer (LA-920 manufactured by HORIBA, Ltd.), was 105 nm. Moreover, a part of the [fine-particles dispersion is 1] thus obtained was dried, and the resin component was isolated (separated). The glass transition temperature (Tg) of the resin component was 59° C., and the mass-average molecular weight was 150,000.

—Synthesis of Polyester Resin (1)—

In a reaction vessel equipped with a cooling pipe, a stirrer, and a nitrogen feeding tube, placed were 229 parts by mass of ethylene oxide two-mole adduct of bisphenol A, 529 parts by mass of propylene oxide three-mole adduct of bisphenol A, 208 parts by mass of terephthalic acid, 46 parts by mass of adipic acid, and 2 parts by mass of dibutyl tin oxide, and the mixture was allowed to react at 230° C. for eight hours, under a normal pressure. Next, after the mixture was allowed to react under a reduced pressure of 10 mm Hg to 15 mm Hg for five hours, 30 parts by mass of trimellitic anhydride was added to the reaction vessel, and allowed to react at 180° C. for two hours under the normal pressure, to yield polyester resin (1).

The polyester resin 1 obtained had a mass average molecular weight of 6,700, a glass transition temperature (Tg) of 43° C., and an acid value of 20 mg KOH/g.

—Preparation of Aqueous Phase—

A milk-white liquid (aqueous phase) was obtained by mixing and stirring 990 parts by mass of water, 83 parts by mass of the fine particles dispersion 1, 37 parts by mass of 48.5% by mass aqueous solution of sodium dodecyl diphenyl ether disulfonate ("ELEMINOL MON-7 manufactured by Sanyo Chemical Industries, Ltd), and 90 parts by mass of ethyl acetate.

—Synthesis of Low Molecular Weight Polyester Resin—

In a reaction vessel equipped with a cooling pipe, a stirrer, and a nitrogen feeding tube, placed were 682 parts by mass of ethylene oxide two-mole adduct of bisphenol A, 81 parts by mass of propylene oxide two-mole adduct of bisphenol A, 283 parts by mass of terephthalic acid, 22 parts by mass of trimellitic anhydride, and 2 parts by mass of dibutyl tin oxide, and the mixture was allowed to react at 230° C. for five hours under a normal pressure to prepare a low molecular weight polyester resin.

The low molecular weight polyester resin obtained had a number average molecular weight of 2,100, a mass average molecular weight of 9,500, a glass transition temperature (Tg) of 55° C., an acid value of 0.5 mg KOH/g, and a hydroxyl group value of 51 mgKOH/g.

—Synthesis of Modified Polyester Resin Having a Substituent Group Capable of Reacting—

In a reaction vessel equipped with a cooling pipe, a stirrer, and a nitrogen feeding tube, placed were 410 parts by mass of the low molecular weight polyester resin, 89 parts by mass of isophorone diusocyanate, and 500 parts by mass of ethyl acetate, and the mixture was allowed to react at 100° C. for five hours to prepare a modified polyester resin having a substituent group capable of reacting (polymer capable of reacting with the compound containing a active hydrogen group).

Free isocyanate content of the thus obtained modified polyester resin having a substituent group capable of reacting was 1.53% by mass.

—Preparation of Master Batch—

A mixture of 1,200 parts by mass of water, 270 parts by mass of C. I. Pigment Blue (PB) 15:3 (7351, manufactured by TOYO INK MFG. CO., LTD.) as a colorant, 54 parts by mass of an acrylic pigment dispersant (DISPERBYK2000, manufactured by BYK Japan K.K.), 8.1 parts by mass of a synergist (SOLSPERSE5000, manufactured by Lubrizol Japan Ltd.), and 1,200 parts by mass of the polyester resin (1), was mixed by HENSCHEL MIXER (manufactured by Mitsui Mining Co., Ltd.). After the mixture was kneaded for 30 minutes at 150° C. using a two-roll mill, the mixture was cold-rolled and pulverized in a pulverizer (manufactured by Hosokawa Micron Corporation) to prepare a master batch.

—Preparation of Organic Solvent Phase—

In a reaction vessel equipped with a stirrer and a thermometer, placed were 378 parts by mass of the polyester resin (1), 110 parts by mass of carnauba wax, and 947 parts by mass of ethyl acetate. The mixture was heated to 80° C. while stirring, and after leaving the mixture at 80° C. for 30 hr, the mixture was cooled down to 30° C. in one hour to obtain a raw material solution.

Next, 1,324 parts by mass of the raw material solution thus obtained was transferred to the reaction vessel, and by using a bead mill (ULTRAVISCO MILL manufactured by Aimex Co., Ltd.), the carnauba wax was dispersed for 9 hr under the conditions: liquid feeding speed: 1 kg/hr; disc circumferential velocity: 6 m/sec; and amount of 0.5-mm zirconia beads filled: 80% by volume.

Next, into the dispersion, 1,324 parts by mass of an ethyl acetate solution of 65% by mass of the low molecular weight polyester was added, then 500 parts by mass of the master batch and 500 parts by mass of ethyl acetate were placed, and the mixture was stirred for one hour. Next, while keeping the temperature of the mixture at 25° C., the mixture was passed through Ebara Milder (a combination of G, M, and S from the entrance) at a flow rate of 1 kg/min four times to prepare an organic solvent phase (pigment and wax dispersion).

A solid concentration (at 130° C. for 30 minutes) of the organic solvent phase obtained was 50% by mass.

—Emulsification or Dispersing—

Into the reaction vessel, 749 parts by mass of the organic solvent phase, 115 parts by mass of the modified polyester resin having a substituent group capable of reacting, and 2.9 parts by mass of isophorone diamine (manufactured by Wako Pure Chemical Industries, Ltd.) were placed, and the mixture was mixed for one minute at 5,000 rpm by using a homo mixer (TK HOMO MIXER MKII, manufactured by Tokushu Kika Kogyo Co., Ltd.). Next, 1,200 parts by mass of the aqueous phase were added to the reaction vessel, and the mixture was mixed for three minutes at 9,000 rpm, by the homo mixer. Subsequently, the resulting mixture was stirred for 20 min by a stirrer to yield an emulsified slurry.

Next, the emulsified slurry was placed in a reaction vessel equipped with a stirrer and a thermometer, and the solvent was removed at 25° C. After the organic solvent was removed, the emulsified slurry was aged at 45° C. for 15 hr to obtain a dispersion slurry.

—Washing—

After 100 parts by mass of the dispersion slurry was filtered under a reduced pressure, 100 parts of ion-exchange water was added to the filtered cake. The mixture was mixed by the homo mixer (at 8,000 rpm for 10 minutes), and then filtered. To the filtered cake thus obtained, 100 parts by mass of ion-exchange water was added. The mixture was mixed by the homo mixer (at 8,000 rpm for 10 minutes), and then filtered under a reduced pressure. To the filtered cake thus obtained, 100 parts by mass of 10% by mass sodium hydroxide aqueous solution was added. The mixture obtained was mixed by the homo mixer (at 8,000 rpm for 10 minutes), and then filtered. To the filtered cake thus obtained, 100 parts by mass of 10% hydrochloric acid was added. The mixture thus obtained was mixed by the homo mixer (at 8,000 rpm for 10 minutes), and then filtered. To the filtered cake thus obtained, 300 parts by mass of ion-exchange water was added, and the mixture thus obtained was mixed by the homo mixer (at 8,000 rpm for 10 minutes) and then filtered. The last step was carried out twice and a filtered final cake was obtained. The filtered final cake thus obtained was dried at 45° C. for 48 hr in a circulating-air dryer, and then sieved through a 75 μm opening mesh to obtain toner base particles of Example 1.

—Treatment with External Additive—

In a Henschel mixer, 100 parts by mass of the toner base particles of Example 1 thus obtained and 0.5 parts by mass of hydrophobic silica (H2000, manufactured by Clariant (Japan) K.K.; the average particle diameter of primary particles: 10 nm) as an external additive were mixed to prepare toner 1 of Example 1.

Example 2

Preparation of Toner 2

Toner 2 was prepared in the same manner as in Example 1 except that the procedure for preparing the master batch was changed to the following.

—Preparation of Master Batch—

A mixture of 1,200 parts by mass of water, 405 parts by mass of C. I. PR269 (1022M, manufactured by DIC Corporation) as a colorant, 81 parts by mass of a polyurethane pigment dispersant (EFKA4080, manufactured by Chiba Specialty Chemicals, Inc.), and 1,200 parts by mass of the polyester resin (1), was mixed by HENSCHEL MIXER (manufactured by Mitsui Mining Co., Ltd.). After the mixture was kneaded for 30 minutes at 150° C. using a two-roll mill, the mixture was cold-rolled and pulverized in a pulverizer (manufactured by Hosokawa Micron Corporation) to prepare a master batch.

Example 3

Preparation of Toner 3

Toner 3 was prepared in the same manner as in Example 1 except that the procedure for preparing the master batch was changed to the following.

—Preparation of Master Batch—

A mixture of 1,200 parts by mass of water, 540 parts by mass of C. I. PY155 (YELLOW 4G-PT VP2669, manufactured by Clariant (Japan) K.K.) as a colorant, 108 parts by mass of a polyester pigment dispersant (AJISPER821, manufactured by Ajinomoto Fine-Techno Co., Inc.), 16 parts by mass of a synergist (EFKA6750, manufactured by Chiba Specialty Chemicals, Inc.), and 1,200 parts by mass of the polyester resin (1), was mixed by HENSCHEL MIXER (manufactured by Mitsui Mining Co., Ltd.). After the mixture was kneaded for 30 minutes at 150° C. using a two-roll mill, the mixture was cold-rolled and pulverized in a pulverizer (manufactured by Hosokawa Micron Corporation) to prepare a master batch.

Example 4

Preparation of Toner 4

Toner 4 was prepared in the same manner as in Example 1, except that the procedure for preparing the master batch was changed to the following procedure for preparing a pigment dispersion and the procedure for preparing the organic solvent phase was changed to the following.

—Preparation of Pigment Dispersion Liquid—

A mixture of 7,000 parts by mass of ethyl acetate, 1,500 parts by mass of C. I. PB 15:3 (FASTGEN BLUE GCTF, manufactured by DIC Corporation) as a colorant, 300 parts by mass of an acrylic pigment dispersant (DISPERBYK2000, manufactured by BYK Japan K.K.), and 1,500 parts by mass of the polyester resin (1), was mixed, and by using a bead mill (a horizontal wet disperser, DYNO-MILL, manufactured by Shinmaru Enterprises Corporation), the mixture thus obtained was dispersed for 6 hr under the conditions: liquid feeding speed: 1 kg/hr; disc circumferential velocity: 6 m/sec; amount of 0.5-mm zirconia beads filled: 80% by volume; to prepare a pigment dispersion.

—Preparation of Organic Solvent Phase—

In a reaction vessel equipped with a stirrer and a thermometer, placed were 378 parts by mass of the polyester resin (1), 110 parts by mass of carnauba wax, and 947 parts by mass of ethyl acetate. The mixture was heated to 80° C. while stirring, and after leaving the mixture at 80° C. for 30 hr, the mixture was cooled down to 30° C. in one hour to obtain a raw material solution.

Next, 1,324 parts by mass of the raw material solution thus obtained was transferred to the reaction vessel, and by using a bead mill (ULTRAVISCO MILL manufactured by Aimex Co., Ltd.), the carnauba wax was dispersed for 9 hr under the conditions: liquid feeding speed: 1 kg/hr; disc circumferential velocity: 6 m/sec; and amount of 0.5-mm zirconia beads filled: 80% by volume.

Next, into the dispersion, 940 parts by mass of an ethyl acetate solution of 65% by mass of the low molecular weight polyester was added, then 1,667 parts by mass of the pigment dispersion and 250 parts by mass of ethyl acetate were placed, and the mixture was stirred for one hour. Next, while keeping the temperature of the mixture at 25° C., the mixture was passed through Ebara Milder (a combination of G, M, and S from the inlet) at a flow rate of 1 kg/min four times to prepare an organic solvent phase (pigment and wax dispersion).

A solid concentration (at 130° C. for 30 minutes) of the organic solvent phase obtained was 50% by mass.

Example 5

Preparation of Toner 5

Toner 5 was prepared in the same manner as in Example 4, except that the procedure for preparing the pigment dispersion and the procedure for preparing the organic solvent phase were changed to the following.

—Preparation of Pigment Dispersion—

A mixture of 7,000 parts by mass of ethyl acetate, 1,500 parts by mass of C. I. PR269 (1022KB, manufactured by DIC Corporation) as a colorant, 300 parts by mass of a polyurethane pigment dispersant (EFKA4080, manufactured by Chiba Specialty Chemicals, Inc.), and 150 parts by mass of the polyester resin (1), was mixed, and by using a bead mill (a horizontal wet disperser, DYNO-MILL, manufactured by Shinmaru Enterprises Corporation), the mixture thus obtained was dispersed for 6 hr to prepare a pigment dispersion.

—Preparation of Organic Solvent Phase—

In a reaction vessel equipped with a stirrer and a thermometer, placed were 378 parts by mass of the polyester resin (1), 110 parts by mass of carnauba wax, and 947 parts by mass of ethyl acetate. The mixture was heated to 80° C. while stirring, and after leaving the mixture at 80° C. for 30 hr, the mixture was cooled down to 30° C. in one hour to obtain a raw material solution.

To the reaction vessel, 1,324 parts by mass of the raw material solution thus obtained was transferred, and by using a bead mill (ULTRAVISCO MILL manufactured by Aimex Co., Ltd.), the carnauba wax was dispersed for 9 hr under the conditions: liquid feeding speed: 1 kg/hr; disc circumferential velocity: 6 m/sec; and amount of 0.5-mm zirconia beads filled: 80% by volume.

Next, into the dispersion, 1,074 parts by mass of an ethyl acetate solution of 65% by mass of the low molecular weight polyester was added, then 2,500 parts by mass of the pigment dispersion was placed, and the mixture was stirred for one hour. Next, while keeping the temperature of the mixture at 25° C., the mixture was passed through Ebara Milder (a combination of G, M, and S from the entrance) at a flow rate of 1 kg/min four times to prepare an organic solvent phase (pigment and wax dispersion).

A solid concentration (at 130° C. for 30 minutes) of the organic solvent phase obtained was 45% by mass.

Example 6

Preparation of Toner 6

Toner 6 was prepared in the same manner as in Example 4, except that the procedure for preparing the pigment dispersion and the procedure for preparing the organic solvent phase were changed to the following.

—Preparation of Pigment Dispersion—

A mixture of 7,000 parts by mass of ethyl acetate, 1,500 parts by mass of C. I. PY74 (7416, manufactured by SANYO COLOR WORKS, Ltd.) as a colorant, 20 parts by mass of a polyester pigment dispersant (AJISPER PB822, manufactured by Ajinomoto Fine-Techno Co., Inc.), and 1,500 parts by mass of the polyester resin (1), was mixed, and by using a bead mill (a horizontal wet disperser, DYNO-MILL, manufactured by Shinmaru Enterprises Corporation), the mixture thus obtained was dispersed for 6 hr to prepare a pigment dispersion.

—Preparation of Organic Solvent Phase—

In a reaction vessel equipped with a stirrer and a thermometer, placed were 378 parts by mass of the polyester resin (1), 110 parts by mass of carnauba wax, and 947 parts by mass of ethyl acetate. The mixture was heated to 80° C. while stirring, and after leaving the mixture at 80° C. for 30 hr, the mixture was cooled down to 30° C. in one hour to obtain a raw material solution.

To the reaction vessel, 1,324 parts by mass of the raw material solution thus obtained was transferred, and by using a bead mill (ULTRAVISCO MILL manufactured by Aimex Co., Ltd.), the carnauba wax was dispersed for 9 hr under the conditions: liquid feeding speed: 1 kg/hr; disc circumferential velocity: 6 m/sec; and amount of 0.5-mm zirconia beads filled: 80% by volume.

Next, into the dispersion, 1,074 parts by mass of an ethyl acetate solution of 65% by mass of the low molecular weight polyester was added, then 3,333 parts by mass of the pigment dispersion was placed, and the mixture was stirred for one hour. Next, while keeping the temperature of the mixture at 25° C., the mixture was passed through Ebara Milder (a combination of G, M, and S from the entrance) at a flow rate of 1 kg/min four times to prepare an organic solvent phase (pigment and wax dispersion).

A solid concentration (at 130° C. for 30 minutes) of the organic solvent phase obtained was 43% by mass.

Comparative Example 1

Preparation of Toner 7

Toner 7 was prepared in the same manner as in Example 1 except that the procedure for preparing the master batch was changed to the following.

—Preparation of Master Batch—

A mixture of 1,200 parts by mass of water, 200 parts by mass of C. I. PB15:3 (7351 (trade name), manufactured by TOYO INK MFG. CO., LTD.) as a colorant, and 1,200 parts by mass of the polyester resin (1), was mixed by HENSCHEL MIXER (manufactured by Mitsui Mining Co., Ltd.). After the mixture was kneaded for 30 minutes at 150° C. using a two-roll mill, the mixture was cold-rolled and pulverized in a pulverizer (manufactured by Hosokawa Micron Corporation) to prepare a master batch.

Comparative Example 2

Preparation of Toner 8

Toner 8 was prepared in the same manner as in Example 1 except that the procedure for preparing the master batch was changed to the following.

—Preparation of Master Batch—

A mixture of 1,200 parts by mass of water, 338 parts by mass of C. I. PR269 (1022M, manufactured by DIC Corporation) as a colorant, and 1,200 parts by mass of the polyester resin (1), was mixed by HENSCHEL MIXER (manufactured by Mitsui Mining Co., Ltd.). After the mixture was kneaded for 30 minutes at 150° C. using a two-roll mill, the mixture was cold-rolled and pulverized in a pulverizer (manufactured by Hosokawa Micron Corporation) to prepare a master batch.

Comparative Example 3

Preparation of Toner 9

Toner 9 was prepared in the same manner as in Example 1 except that the procedure for preparing the master batch was changed to the following.

—Preparation of Master Batch—

A mixture of 1,200 parts by mass of water, 608 parts by mass of C. I. PY155 (manufactured by Clariant (Japan) K.K.) as a colorant, and 1,200 parts by mass of the polyester resin (1), was mixed by HENSCHEL MIXER (manufactured by Mitsui Mining Co., Ltd.). After the mixture was kneaded for 30 minutes at 150° C. using a two-roll mill, the mixture was cold-rolled and pulverized in a pulverizer (manufactured by Hosokawa Micron Corporation) to prepare a master batch.

Comparative Example 4

Preparation of Toner 10

Toner 10 was prepared in the same manner as in Example 4, except that the procedure for preparing the pigment dispersion and the procedure for preparing the organic solvent phase were changed to the following.

—Preparation of Pigment Dispersion—

A mixture of 7,000 parts by mass of ethyl acetate, 1,500 parts by mass of C. I. PB 15:3 (FASTGEN BLUE GCTF, manufactured by DIC Corporation) as a colorant, 300 parts by mass of an acrylic pigment dispersant (DISPERBYK2000, manufactured by BYK Japan K.K.), and 1,500 parts by mass of the polyester resin (1), was mixed, and by using a bead mill (a horizontal wet disperser, DYNO-MILL, manufactured by Shinmaru Enterprises Corporation), the mixture thus obtained was dispersed for 6 hr under the conditions: liquid feeding speed: 1 kg/hr; disc circumferential velocity: 6 m/sec; amount of 0.5-mm zirconia beads filled: 80% by volume; to prepare a pigment dispersion.

—Preparation of Organic Solvent Phase—

In a reaction vessel equipped with a stirrer and a thermometer, placed were 378 parts by mass of the polyester resin (1), 110 parts by mass of carnauba wax, and 947 parts by mass of ethyl acetate. The mixture was heated to 80° C. while stirring, and after leaving the mixture at 80° C. for 30 hr, the mixture was cooled down to 30° C. in one hour to obtain a raw material solution.

To the reaction vessel, 1,324 parts by mass of the raw material solution thus obtained was transferred, and by using a bead mill (ULTRAVISCO MILL manufactured by Aimex Co., Ltd.), the carnauba wax was dispersed for 9 hr under the conditions: liquid feeding speed: 1 kg/hr; disc circumferential velocity: 6 m/sec; and amount of 0.5-mm zirconia beads filled: 80% by volume.

Next, into the dispersion, 940 parts by mass of an ethyl acetate solution of 65% by mass of the low molecular weight polyester resin was added, then 1,917 parts by mass of the pigment dispersion was placed, and the mixture was stirred for one hour. Next, while keeping the temperature of the mixture at 25° C., the mixture was passed through Ebara Milder (a combination of G, M, and S from the entrance) at a flow rate of 1 kg/min four times to prepare an organic solvent phase (pigment and wax dispersion).

A solid concentration (at 130° C. for 30 minutes) of the organic solvent phase obtained was 50% by mass.

Comparative Example 5

Preparation of Toner 11

Toner 11 was prepared in the same manner as in Example 5, except that the procedure for preparing the pigment dispersion and the procedure for preparing the organic solvent phase were changed to the following.

—Preparation of Pigment Dispersion—

A mixture of 7,000 parts by mass of ethyl acetate, 1,500 parts by mass of C. I. PR269 (1022KB, manufactured by DIC Corporation) as a colorant, 470 parts by mass of a polyurethane pigment dispersant (EFKA4080, manufactured by Chiba Specialty Chemicals, Inc.), and 150 parts by mass of the polyester resin (1), was mixed, and by using a bead mill (a horizontal wet disperser, DYNO-MILL, manufactured by Shinmaru Enterprises Corporation), the mixture thus obtained was dispersed for 6 hr to prepare a pigment dispersion.

—Preparation of Organic Solvent Phase—

In a reaction vessel equipped with a stirrer and a thermometer, placed were 378 parts by mass of the polyester resin (1), 110 parts by mass of carnauba wax, and 947 parts by mass of ethyl acetate. The mixture was heated to 80° C. while stirring, and after leaving the mixture at 80° C. for 30 hr, the mixture was cooled down to 30° C. in one hour to obtain a raw material solution.

To the reaction vessel, 1,324 parts by mass of the raw material solution thus obtained was transferred, and by using a bead mill (ULTRAVISCO MILL manufactured by Aimex Co., Ltd.), the carnauba wax was dispersed for 9 hr under the conditions: liquid feeding speed: 1 kg/hr; disc circumferential velocity: 6 m/sec; and amount of 0.5-mm zirconia beads filled: 80% by volume.

Next, into the dispersion, 1,074 parts by mass of an ethyl acetate solution of 65% by mass of the low molecular weight polyester was added, then 1,500 parts by mass of the pigment dispersion was placed, and the mixture was stirred for one hour. Next, while keeping the temperature of the mixture at 25° C., the mixture was passed through Ebara Milder (a combination of G, M, and S from the entrance) at a flow rate of 1 kg/min four times to prepare an organic solvent phase (pigment and wax dispersion).

A solid concentration (at 130° C. for 30 minutes) of the organic solvent phase obtained was 50% by mass.

Next, for each toner thus obtained, the volume average particle diameter (Dv), the number average particle diameter (Dn), the ratio of Dv to Dn (Dv/Dn), and the haze degree were measured as follows. The results are shown in Table 1.

<Measurement of Volume Average Particle Diameter (Dv), Number Average Particle Diameter (Dn), and Ratio (Dv/Dn) of Toner>

The volume average particle diameter (Dv), the number average particle diameter (Dn), and the ratio of Dv to Dn (Dv/Dn) of each toner were determined using a particle size measurement device ("MULTI SIZER III", manufactured by Beckman Coulter K.K.) with an aperture diameter of 100 μm, and analyzed by analysis software (BECKMAN COULTER MULTISIZER 3 Version 3.51). Specifically, into a 100 ml glass beaker, 0.5 ml of a 10% by mass surfactant (alkylbenzene sulfonate, NEOGEN SC-A; manufactured by Dai-ichi Kogyo Seiyaku Co., Ltd.) was added, 0.5 g of each of each toners was added and stirred by a micro spatula, and then to the resultant mixture, 80 ml of ion-exchange water was added. The dispersion thus obtained was subjected to a 10 minutes dispersion treatment using an ultrasonic dispersing device (W-113MK-II manufactured by HONDA ELECTRONICS CO., LTD). The particle diameters of the toner particles in the dispersion were measured using the MULTISIZER III and ISOTON III (manufactured by Beckman Coulter K.K.) as a solution for measurement. In the measurement, the toner sample dispersion was delivered by drops so that the concentration indicated by the device was 8±2%. In this measurement method, it is important to control the concentration of the dispersion to 8±2% from the viewpoint of reproducibility of the measurement of the particle diameter. As far as the concentration is in this range, inaccuracy of the particle diameter does not occur.

<Measurement of Haze Degree>

Each toner (10 g) was added to 40 g of tetrahydrofuran (THF), the mixture thus obtained was stirred by a magnetic stirrer to dissolve the toner in THF. The solution thus obtained was applied on a transparent film (HA-88, manufactured by HIGASHIYAMA FILM CO., LTD.) to prepare a thin coat layer sample. The thin coat layer sample was prepared using a 0.3-mm wire bar such that the thickness of the film was 5 μm. The haze degree of the thin coat layer sample thus obtained was measured by TM double beam type automatic haze computer (manufactured by SUGA TEST INSTRUMENTS CO., LTD.).

—Preparation of Developer—

A mixture of 2.5 parts by mass of each toner thus obtained and 97.5 parts by mass of a ferrite carrier coated with silicone (particle diameter of the core material: 45 μm) was stirred by using a turbular mixer (manufactured by Shinmaru Enterprises Corporation). In this way, each two component developer for Examples 1 to 6 and Comparative Examples 1 to 5 was prepared.

Next, using each of the developers thus obtained, the reflection density (ID), the color saturation, the resolution, and cleaning ability were evaluated as follows. The results are shown in Table 1.

B: The resolution was slightly poorer than A

C: Fine parts of the image were unrecognizable

<Evaluation of Cleaning Ability>

After a chart having an image area ratio of 95% was printed on 1,000 sheets of paper by using an image forming apparatus (IMAGIO NE0450, manufactured by Ricoh Company, Ltd.), an untransferred residual toner which had been passed through the cleaning step and was left on a photoconductor, was transferred with SCOTCH TAPE (manufactured by Sumitomo 3M Ltd.) onto a white paper sheet. The reflection density of the transferred residual toner was measured by MACBETH REFLECTION DENSITOMETER RD514 TYPE, and the cleaning ability was evaluated according to the following criteria.

[Evaluation Criteria]

A: The reflection density was less than 0.010

B: The reflection density was 0.011 to less than 0.020

C: The reflection density was 0.020 or more

TABLE 1

| | Pigment concentration (% by mass) | Dv (μm) | Dn (μm) | Dv/Dn | Haze degree | Reflection density (ID) | Color saturation | Resolution | Cleaning ability |
|---|---|---|---|---|---|---|---|---|---|
| Ex. 1 | 4.0 | 4.9 | 4.3 | 1.14 | 15.1 | 1.31 | 60.5 | A | A |
| Ex. 2 | 6.0 | 4.7 | 4.2 | 1.12 | 20.2 | 1.27 | 71.2 | A | A |
| Ex. 3 | 8.0 | 4.0 | 3.5 | 1.14 | 24.3 | 1.22 | 86.5 | A | B |
| Ex. 4 | 4.0 | 4.1 | 3.8 | 1.08 | 3.6 | 2.23 | 63.5 | A | A |
| Ex. 5 | 6.0 | 4.2 | 3.9 | 1.08 | 4.4 | 2.34 | 74.2 | A | A |
| Ex. 6 | 8.0 | 4.3 | 3.9 | 1.10 | 5.6 | 2.12 | 88.5 | A | A |
| Comp. Ex. 1 | 3.0 | 6.5 | 5.1 | 1.27 | 34.6 | 1.05 | 32.3 | C | B |
| Comp. Ex. 2 | 5.0 | 4.7 | 3.6 | 1.31 | 46.2 | 0.87 | 59.8 | C | C |
| Comp. Ex. 3 | 9.0 | 5.5 | 4.4 | 1.25 | 50.3 | 0.75 | 60.3 | C | C |
| Comp. Ex. 4 | 4.6 | 4.9 | 3.85 | 1.27 | 6.5 | 2.6 | 57.3 | C | B |
| Comp. Ex. 5 | 2.5 | 5.1 | 4.2 | 1.21 | 8.3 | 0.9 | 69.3 | C | B |

<Measurement of Reflection Density (ID)>

A solid image was printed on sheets of transfer paper of regular paper and cardboard type (TYPE6200, manufactured by Ricoh Company, Ltd. and copy printing paper <135>, manufactured by Ricoh Business Expert, Ltd.), using an image forming apparatus (IMAGIO NE0450, manufactured by Ricoh Company, Ltd.) which was adjusted such that each toner was developed with a toner adhesion amount of 0.25 $mg/cm^2$ and which was operated at a temperature of a fixing belt (160° C.) to fix the solid image. For the solid images printed on the sheets, the reflection density (ID) was measured by X-RITE (manufactured by X-Rite Co.).

<Evaluation of Color Saturation>

The color saturation was determined by calculating values of a* and b* that had been measured by X-RITE (manufactured by X-Rite Co.) at the same time as the reflection density (ID) based on an equation: $[\text{color saturation}]=\sqrt{(a^{*2}+b^{*2})}$. In the present invention, the color saturation is preferably substantially equivalent to a color saturation in Japan Color (the difference is 3 or less). Specifically the color saturation in Japan Color is 91.80 for yellow, 75.23 for magenta, and 62.28 for cyan.

<Evaluation of Resolution>

The resolution was evaluated based on the following criteria, using an N2 image according to JIS/JIS-SCID which was printed by an image forming apparatus (IMAGIO NE0450, manufactured by Ricoh Company, Ltd.).

[Evaluation Criteria]

A: Even fine parts of the image could be visually recognized

Since a toner according to the present invention achieves a sufficient image density with a normal addition amount of pigment, without the necessity of adding a large amount of pigment, even with a low toner adhesion amount, decreases a toner consumption rate, thereby contributing to a solution to environmental problems, achieves high image quality, and can enlarge color reproduction range, it is preferably used for full color image formation.

An image forming apparatus, an image forming method, and a process cartridge according to the present invention use the toner according to the present invention and are thus capable of forming an image of extremely high quality, therefore they can be widely used for, for example, laser printers, direct digital platemaking machines, full-color copiers using a direct or indirect electrophotographic multicolor image developing method, full-color laser printers, and full-color fax machines for regular paper.

What is claimed is:

1. A toner comprising:

a binder resin, a pigment, a pigment dispersant, and a synergist;

wherein the pigment is present in the toner in an amount of from 3.0% by mass to 8.5% by mass, the toner has a volume average particle diameter of from 2.0 μm to 6.0 μm and a number average particle diameter of 3.5 μm to 4.3 μm, and a ratio (Dv/Dn) of a volume average particle diameter (Dv) to a number average particle diameter (Dn) of 1.00 to 1.20, wherein a monochrome image, which has been fixed on a recording medium so that the amount of the toner adhered onto the recording medium is 0.25 mg/cm$^2$, has a reflection density of 1.2 to 2.5, wherein the reflection density is of a monochrome image which is fixed at 160° C., wherein a coat layer prepared by applying onto a base a solution in which 10 g of the toner is dissolved in 40 g of tetrahydrofuran, using a wire bar having a wire diameter of 0.3 mm, has a haze degree of 0.1 to 25.

2. The toner according to claim 1, wherein the pigment dispersant is a polyester pigment dispersant.

3. The toner according to claim 1, wherein the pigment dispersant is a polyurethane pigment dispersant.

4. The toner according to claim 1, wherein the pigment dispersant is an acrylic pigment dispersant.

5. The toner according to claim 1, wherein the toner is at least one selected from a yellow toner, a magenta toner, and a cyan toner.

6. The toner according to claim 1, wherein the toner is obtained by dissolving or dispersing in an organic solvent at least a binder resin and a pigment to prepare a solution or dispersion, suspending or emulsifying the solution or dispersion in an aqueous medium so as to obtain a granulated dispersion liquid, and removing the solvent from the dispersion liquid.

7. The toner according to claim 1, wherein the toner is obtained by dissolving or dispersing in an organic solvent at least a compound having an active hydrogen group and a polymer having a site capable of reacting with the compound having an active hydrogen group to obtain a solution or a dispersion, subjecting the solution or dispersion to a cross-linking or elongation reaction in an aqueous medium to obtain a dispersion liquid, and removing the solvent from the dispersion liquid.

8. The toner according to claim 7, wherein the polymer having a site capable of reacting with the compound having an active hydrogen group is a modified polyester resin (i) having a substituent capable of undergoing a cross-linking or an elongation reaction.

9. The toner according to claim 8, wherein the substituent capable of undergoing a cross-linking or an elongation reaction in the modified polyester resin (i) is an isocyanate group.

10. The toner according to claim 6, wherein the binder resin comprises an unmodified polyester resin (ii) together with the modified polyester resin (i) formed by a cross-linking or an elongation reaction, and a mass ratio [(i)/(ii)] is 5/95 to 30/70.

11. A developer comprising:

a toner, and a carrier, wherein the toner comprises a binder resin, a synergist, a pigment dispersant, and a pigment, the pigment is present in the toner in an amount of from 3.0% by mass to 8.5% by mass, the toner has a volume average particle diameter of from 2.0 μm to 6.0 μm and a number average particle diameter of 3.5 μM to 4.3 μm, and a ratio (Dv/Dn) of a volume average particle diameter (Dv) to the number average particle diameter (Dn) of 1.00 to 1.20, wherein a monochrome image, which has been fixed on a recording medium so that the amount of the toner adhered onto the recording medium is 0.25 mg/cm$^2$, has a reflection density of 1.2 to 2.5, wherein the reflection density is of a monochrome image which is fixed at 160° C., wherein a coat layer prepared by applying onto a base a solution in which 10 g of the toner is dissolved in 40 g of tetrahydrofuran, using a wire bar having a wire diameter of 0.3 mm, has a haze degree of 0.1 to 25.

12. An image forming method comprising:

forming a latent electrostatic image on a latent electrostatic image bearing member, developing the latent electrostatic image using a toner according to claim 1 to form a visible image, transferring the visible image onto a recording medium, and fixing the transferred image on the recording medium.

13. A toner comprising:

a binder resin, a pigment, an acrylic pigment dispersant, and a synergist;

wherein the pigment is present in the toner in an amount of from 3.0% by mass to 8.5% by mass, the toner has a volume average particle diameter of from 2.0 μm to 6.0 μm and a number average particle diameter of 3.5 μm to 4.3 μm, wherein a monochrome image, which has been fixed on a recording medium so that the amount of the toner adhered onto the recording medium is 0.25 mg/cm$^2$, has a reflection density of 1.2 to 2.5, wherein the reflection density is of a monochrome image which is fixed at 160° C., wherein a coat layer prepared by applying onto a base a solution in which 10 g of the toner is dissolved in 40 g of tetrahydrofuran, using a wire bar having a wire diameter of 0.3 mm, has a haze degree of 0.1 to 25.

14. The toner according to claim 13, wherein the toner is at least one selected from a yellow toner, a magenta toner, and a cyan toner.

15. A developer comprising:

a toner according to claim 13; and a carrier.

* * * * *